US006908158B2

(12) United States Patent
Willette et al.

(10) Patent No.: US 6,908,158 B2
(45) Date of Patent: Jun. 21, 2005

(54) LATERAL MOTION CHAIR ARM MECHANISM FOR CHAIR ARM

(75) Inventors: Joe Willette, Grand Haven, MI (US); Eric J. Boone, Comstock Park, MI (US)

(73) Assignee: Haworth, Inc., Holland, MI (US)

( * ) Notice: Subject to any disclaimer, the term of this patent is extended or adjusted under 35 U.S.C. 154(b) by 14 days.

(21) Appl. No.: 10/336,046

(22) Filed: Jan. 2, 2003

(65) Prior Publication Data

US 2004/0130200 A1 Jul. 8, 2004

(51) Int. Cl.[7] ..... A47C 7/54

(52) U.S. Cl. ..... 297/411.37; 297/411.35; 297/411.36

(58) Field of Search ..... 297/411.37, 411.38, 297/411.35, 411.36

(56) References Cited

U.S. PATENT DOCUMENTS

| | | | | | |
|---|---|---|---|---|---|
| 762,877 | A | | 6/1904 | Browne | 297/411.37 |
| 5,380,065 | A | | 1/1995 | Rohrer | 297/411.37 |
| 5,407,249 | A | | 4/1995 | Bonutti | 297/411.35 |
| 5,415,459 | A | | 5/1995 | Schultz | 297/411.37 |
| 5,439,268 | A | * | 8/1995 | Dozsa-Farkas | 297/411.35 |
| 5,484,187 | A | | 1/1996 | Doerner et al. | 297/411.37 X |
| 5,590,934 | A | | 1/1997 | Gibbs | 297/411.38 |
| 5,641,203 | A | | 6/1997 | Van De Riet et al. | 297/411.37 |
| 5,651,586 | A | | 7/1997 | Groth | 297/411.37 |
| 5,655,814 | A | | 8/1997 | Gibbs | 297/411.38 |
| 5,676,483 | A | | 10/1997 | Koubek | 297/411.36 X |
| 5,749,628 | A | | 5/1998 | Synder et al. | 297/411.36 |
| 5,876,097 | A | | 3/1999 | Cao | 297/411.37 |
| 5,884,976 | A | | 3/1999 | Breen et al. | 297/411.37 |
| 5,895,095 | A | * | 4/1999 | Chen | 297/411.36 |
| 5,927,811 | A | | 7/1999 | Tseng | 297/411.37 X |
| 5,931,536 | A | | 8/1999 | Wu | 297/411.35 |
| 6,017,091 | A | | 1/2000 | Cao | 297/411.37 |
| 6,053,578 | A | | 4/2000 | van Hekken et al. | 297/411.35 |
| 6,059,366 | A | | 5/2000 | Hu | 297/411.35 |
| 6,076,891 | A | | 6/2000 | Bernhardt | 297/411.37 |
| 6,076,892 | A | | 6/2000 | van Hekken et al. | 297/411.35 |
| 6,086,156 | A | | 7/2000 | Breen et al. | 297/411.37 |
| 6,203,109 | B1 | * | 3/2001 | Bergsten et al. | 297/411.35 |
| 6,213,556 | B1 | | 4/2001 | Chen | 297/411.35 |
| 6,302,486 | B1 | | 10/2001 | Lamart et al. | 297/411.37 |
| 6,394,553 | B1 | | 5/2002 | McAllister et al. | 297/411.36 |
| 6,460,932 | B1 | | 10/2002 | Kopish et al. | 297/411.36 |
| 6,502,904 | B1 | | 1/2003 | Hansen | 297/411.35 |
| 6,540,300 | B2 | * | 4/2003 | Piretti | 297/411.35 |
| 6,588,847 | B2 | * | 7/2003 | Murakami | 297/411.37 |
| 2002/0036422 | A1 | | 3/2002 | Prince et al. | 297/411.35 |
| 2002/0158501 | A1 | * | 10/2002 | Murakami | 297/411.37 |
| 2003/0030317 | A1 | * | 2/2003 | Chen | 297/411.35 |
| 2004/0066080 | A1 | * | 4/2004 | Maier et al. | 297/411.35 |

* cited by examiner

*Primary Examiner*—Rodney B. White
(74) *Attorney, Agent, or Firm*—Flynn, Thiel, Boutell & Tanis, P.C.

(57) ABSTRACT

A support arm for a chair includes a base component and a support body interconnected therewith wherein opposite ends of the support body are movable longitudinally and laterally. The opposite ends may be displaced simultaneously in opposite lateral directions to permit angular displacement of the support body. The connector arrangement which interconnects the support body to the base component includes two sets of locking formations wherein the first set include longitudinally elongate parallel slots and the second set include an array of lateral rows and longitudinal columns of openings. The holes define the lateral and longitudinal position of one end of the support body while the slots define the lateral position of the opposite end of the support body.

43 Claims, 24 Drawing Sheets

LATERAL MOTION CHAIR ARM MECHANISM FOR CHAIR ARM

FIELD OF THE INVENTION

The invention relates to a chair arm for an office chair and more particularly, to a chair arm wherein an armrest thereof is adjustable in a longitudinal direction, a lateral direction, and an angular orientation.

BACKGROUND OF THE INVENTION

Office chairs typically include an armrest supported thereon wherein the armrest has a support post on which the armrest is supported. Often, such armrests are adjustable in various directions to support the arm of the user and accommodate the unique physical characteristics of each chair occupant.

Such chair arms include adjustment mechanisms disposed between the support post and the armrest which allow for longitudinal movement in a front to back direction or lateral movement in a side to side direction which is transverse to the longitudinal direction. Also, such armrests have been made angularly adjustable and in some mechanisms, the angular adjustment is provided in combination with longitudinal and lateral adjustment.

It is an object of the invention to provide an improved chair arm arrangement which permits longitudinal, lateral and angular displacement of the armrest relative to the support post.

The invention relates to an improved armrest wherein the longitudinal, lateral and angular displacement of the armrest is governed by intersecting or overlapping slots on the armrest and support post wherein guide pins are slidably received through each pair of overlapping slots. More particularly, the support post includes a longitudinal slot and a transverse slot which are longitudinally spaced apart generally in the same plane, while the armrest includes a similar but oppositely oriented arrangement of a transverse slot and longitudinal slot. As such, the transverse slot on the armrest is disposed directly above the longitudinal slot on the support post with a guide pin being slidably received therebetween. Similarly, the longitudinal slot on the armrest is oriented vertically above and cooperates with the transverse slot on the support post with an additional guide pin being slidably received therebetween. The cooperating pairs of intersecting slots allow for longitudinal and lateral displacement of the armrest. Additionally, the opposite ends of the armrest are movable in opposite lateral directions to each other to adjust the angular orientation of the armrest relative to the support post.

Further, the armrest includes an improved locking arrangement which allows for ready locking and restraint of the armrest in any longitudinal, lateral or angular position and any combination thereof. In this regard, one of the armrests and support posts includes two different patterns of locking formations wherein one pattern of formations are uni-directional and another pattern of formations are bi-directional. First and second locking pins are provided on the other of the armrest and support post with the first locking pin being engageable with the uni-directional formations so as to be restrained only in a lateral or transverse direction and the second locking pin being engageable with the bi-directional formations so as to be restrained in both the longitudinal and transverse directions.

While the locking pins are spaced a fixed distance away from each other along the longitudinal axis of the armrest on which they are mounted, the relative distance along the longitudinal axis on the armrest support post varies depending upon the angular orientation of the armrest relative to the post. As such, engagement of the first locking pin with the bi-directional formation, which preferably is a circular opening, restrains one end of the armrest both laterally and longitudinally and defines the longitudinal position of the armrest relative to the support post. The engagement of the second locking pin with the uni-directional formation, which formation preferably is a slot, restrains the armrest transversely and defines the transverse position of the opposite end of the armrest. While the longitudinal position of the second locking pin varies depending upon the angular orientation of the armrest, the second locking pin is not confined in the longitudinal direction of the slot such that the slots accommodate the various angular positions in which the armrest may be oriented while greatly facilitating alignment of the pin with the slots and avoiding misalignment problems.

The armrest of the invention therefor provides for improved displacement of the armrest as well as improved locking thereof. Other objects and purposes of the invention, and variations thereof, will be apparent upon reading the following specification and inspecting the accompanying drawings.

DETAILED DESCRIPTION

Figure 1:
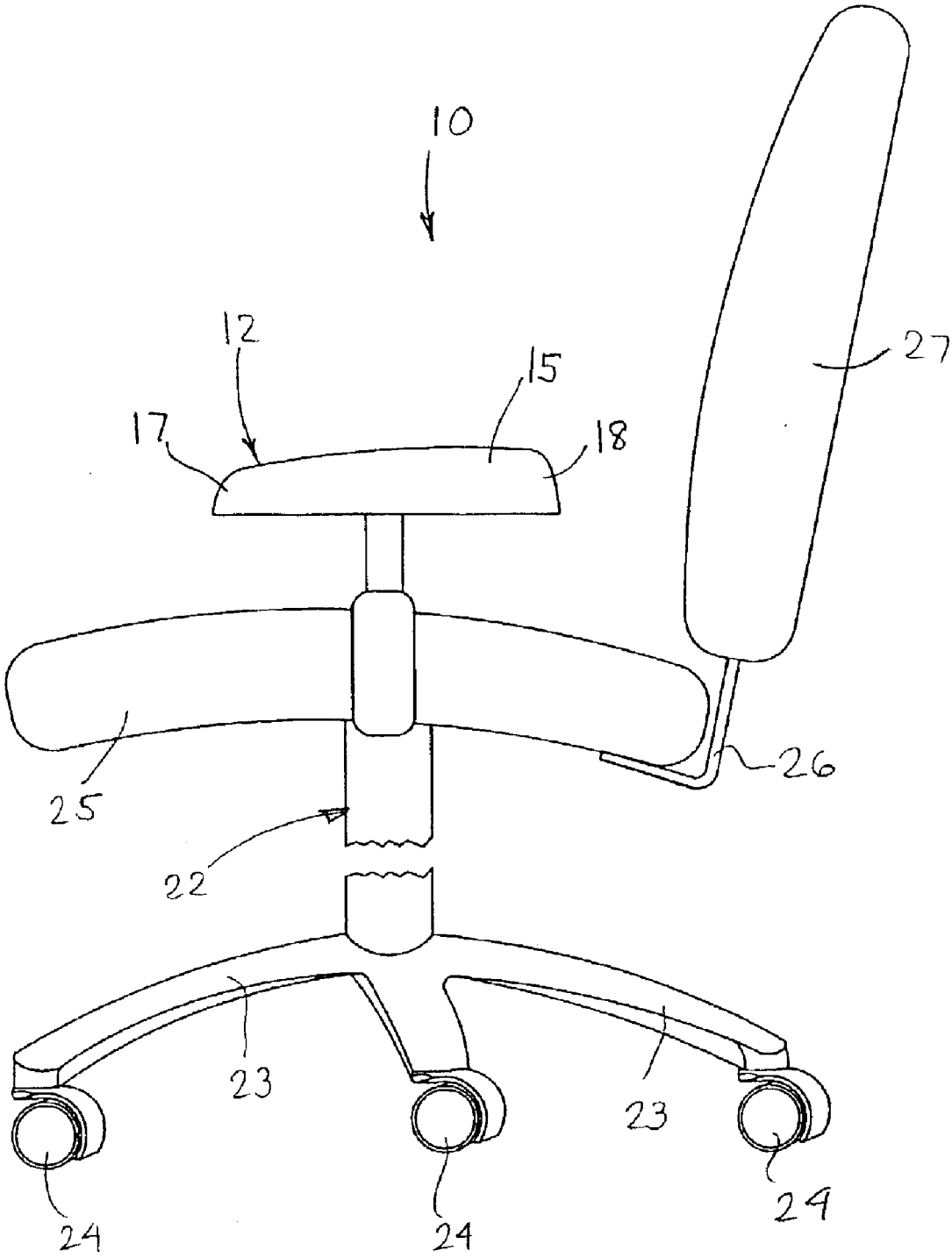
FIG. 1 is a left side elevational view of a chair.
Figure 2:
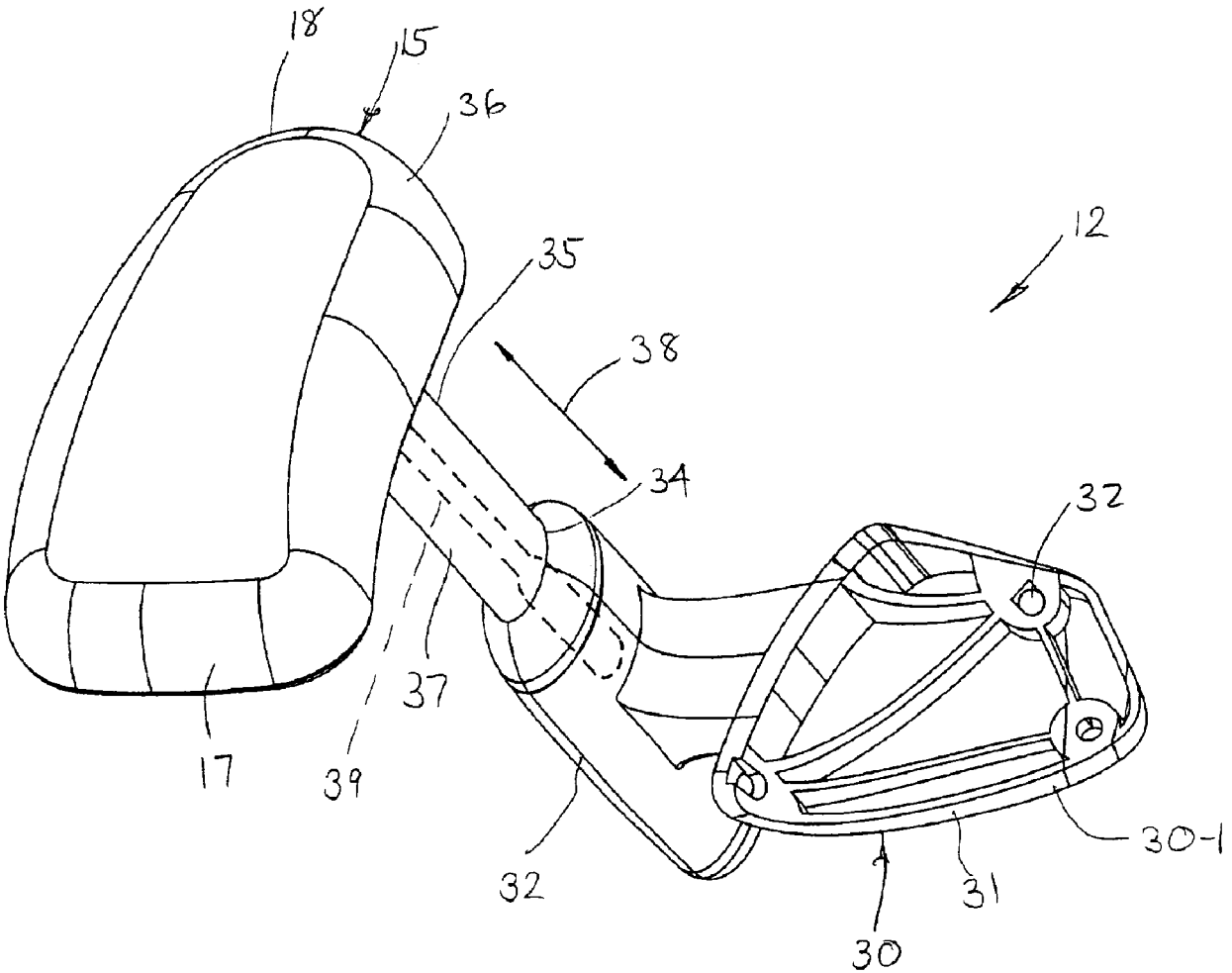
FIG. 2 is a perspective view of a right side chair arm, the left side chair arm being formed identical to but as a mirror image thereof.
Figure 3:
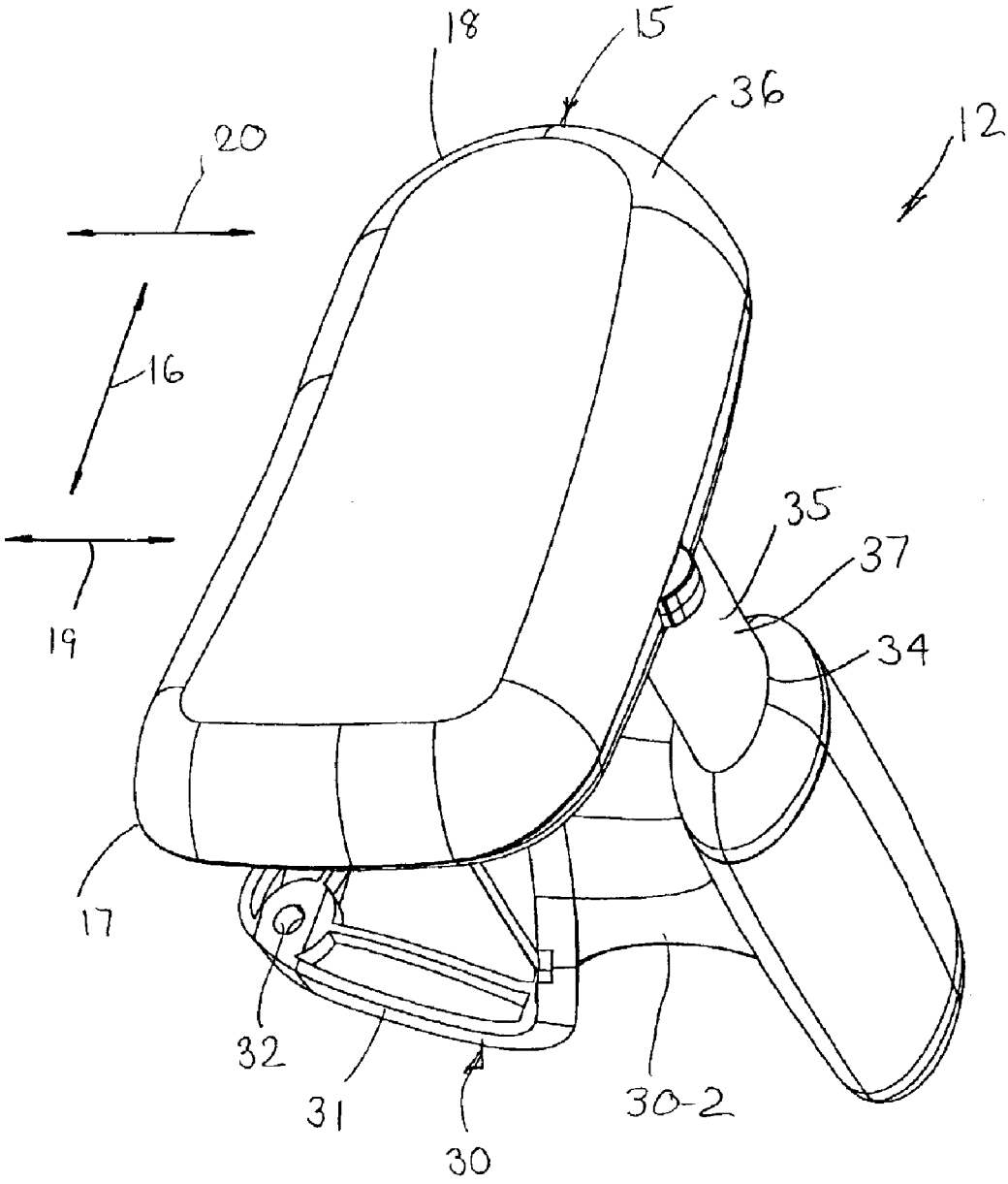
FIG. 3 is a perspective view of the left side chair arm.

Referring to FIGS. 1–3, a chair 10 is illustrated which includes an inventive chair arm assembly 12 mounted thereto. The chair arm 12 as illustrated in FIG. 3 includes an armrest unit 15 which is movable longitudinally in a front-to-back direction identified by reference arrow 16 (FIG. 3). The armrest 15 further has opposite front and back ends 17 and 18 respectively which are movable independently of each other in opposite lateral directions identified by front and rear reference arrows 19 and 20 (FIG. 3) respectively.

More particularly, the chair 10 may be of any conventional construction and typically includes a base 22 which includes radially projecting legs 23 supported on castors 24. The upper end of the base 22 includes a horizontally enlarged seat assembly 25 wherein the rear end of seat assembly 25 supports an L-shaped upright 26. The upright 26 has a vertically enlarged back assembly 27 projecting upwardly therefrom in a conventional arrangement. The seat assembly 25 also supports the left and right chair arms 12 as discussed in further detail herein.

Referring to FIGS. 2 and 3, the chair arms 12 disposed on the opposite sides of the seat assembly 25 are formed substantially identical to each other except that they essentially are formed as mirror images. The following description therefore is applicable to both of the left and right chair arms 12.

More particularly, the chair arm 12 includes an L-shaped mounting bracket 30 which may be a right side version 30-1 (FIG. 2) or a left side version 30-2 (FIG. 3). Each version is formed the same and thus, common reference numerals are used therefor. The bracket 30 includes a horizontal leg 31 which has fastener holes 32 that allow the mounting bracket 30 to be bolted onto the seat assembly 25 laterally adjacent to the seat. The mounting bracket 30 supports a vertical support tube 33 which is formed rigidly at the distal end of the horizontal bracket section 31 and projects vertically. The upper end of the support tube 33 includes an oval opening 34.

The chair arm 12 further includes the armrest 15 which is formed of a post or base section 35 and an armrest assembly 36 which is movably connected to the base section 35. Generally, the post section 35 includes an oval support tube 37 projecting downwardly therefrom which is slidably received within the tube opening 34 in telescoping relation therewith to permit vertical displacement of the armrest assembly 36 generally in the direction of reference arrow 38 (FIG. 2). The entire armrest 15 thereby is vertically displaceable relative to the mounting bracket 30 to accommodate the unique physical characteristics of a chair occupant. The armrest 15 also includes height-adjustment mechanism 39, diagrammatically illustrated in phantom outline in FIG. 2, which adjustment mechanism 39 may have any known construction and operate in a conventional manner to maintain the armrest assembly 36 at a selected elevation relative to the mounting bracket 30.

Figure 4:
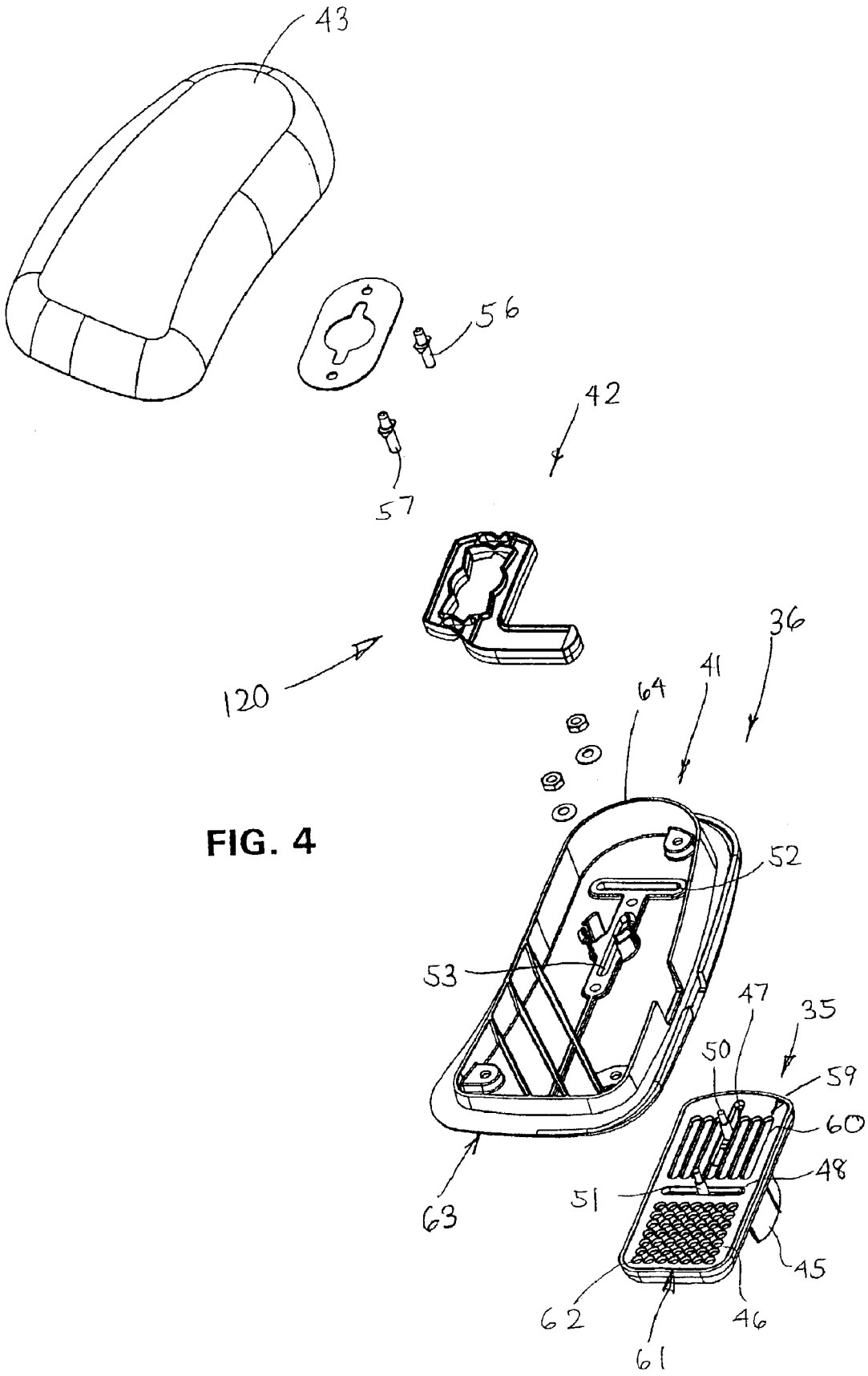
FIG. 4 is an exploded perspective view of the chair arm of FIG. 3 illustrating a support post, an armrest housing, a cover pad and an actuator arrangement therefor.

Referring to FIG. 4, the armrest 15 generally includes the aforementioned post section 35 and the armrest assembly 36. More particularly, the armrest assembly 36 includes an armrest housing 41 which is movably interconnected with the post section 35. The armrest assembly 36 further includes an actuator mechanism 42 and an arm cap 43 which typically is formed of a soft material and snaps onto the armrest housing 41.

As to the post section 35, the post section 35 includes a base housing 45 having a top plate 46 in which is formed a longitudinal slot 47 and a transverse slot 48. The transverse slot 48 is oriented transverse to the longitudinal slot 47 so as to extend in a side-to-side or lateral direction while the longitudinal slot 47 extends in a front-to-back direction. A pair of guide pins 50 and 51 are slidably received through the longitudinal slot 50 and the transverse slot 51 respectively and project upwardly and cooperate with a transverse slot 52 and a longitudinal slot 53 respectively of the armrest housing 41. The sliding cooperation of the guide pins 50 and 51 within the longitudinal slot and transverse slot 47 and 48 and the transverse and longitudinal slots 52 and 53 thereby govern displacement of the armrest assembly 36 relative to the base section 35.

Generally to secure the armrest assembly 36 in a fixed orientation, the actuator assembly 42 is provided with a pair of locking pins 56 and 57 which project downwardly and are adapted to cooperate with the top plate 46 on the base housing 45. The top plate 46 includes a first pattern 59 of uni-directional locking formations 60 which cooperate with the rear locking pin 56, and a second pattern 61 of bi-directional locking formations 62 which cooperate with the front locking pin 57. The bi-directional locking formations 62 prevent movement of the locking pin 57 longitudinally and transversely to effectively fix the position of the front end 63 of the armrest housing 41 while the uni-directional locking formation 60 fixes the back end 64 of the armrest housing 41 only in the lateral direction while the locking pin 56 remains unconfined in the longitudinal direction. This permits ready engagement of the pins 56 and 57 with the first and second patterns 59 and 61 of the locking formations when the armrest assembly 36 is effectively in an angular orientation or lateral or longitudinal position. The specific cooperation and functional relationship of the above-described parts is described in further detail hereinafter.

Figure 8:
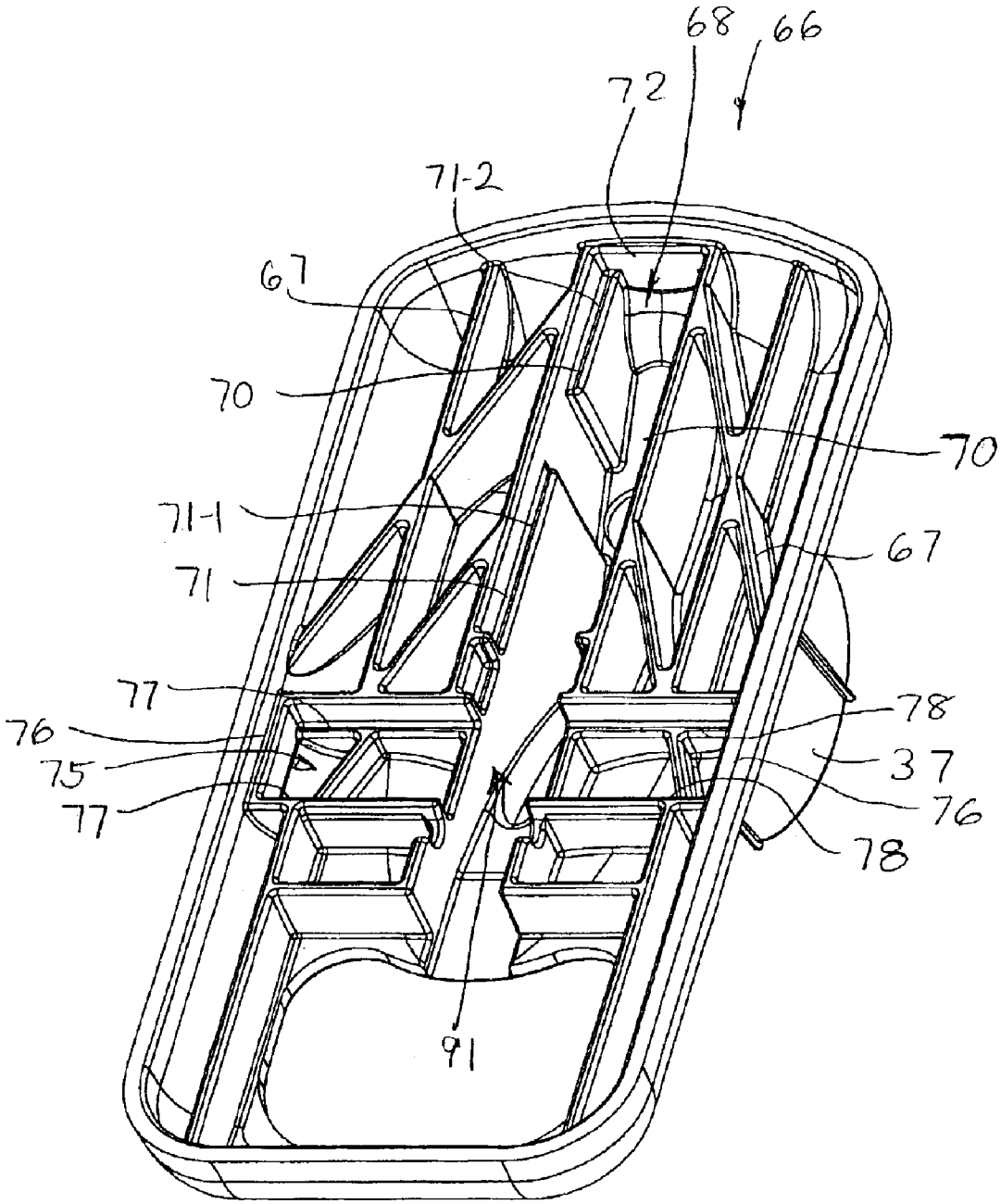
FIG. 8 is a perspective view of a base housing for the support post.
Figure 9:
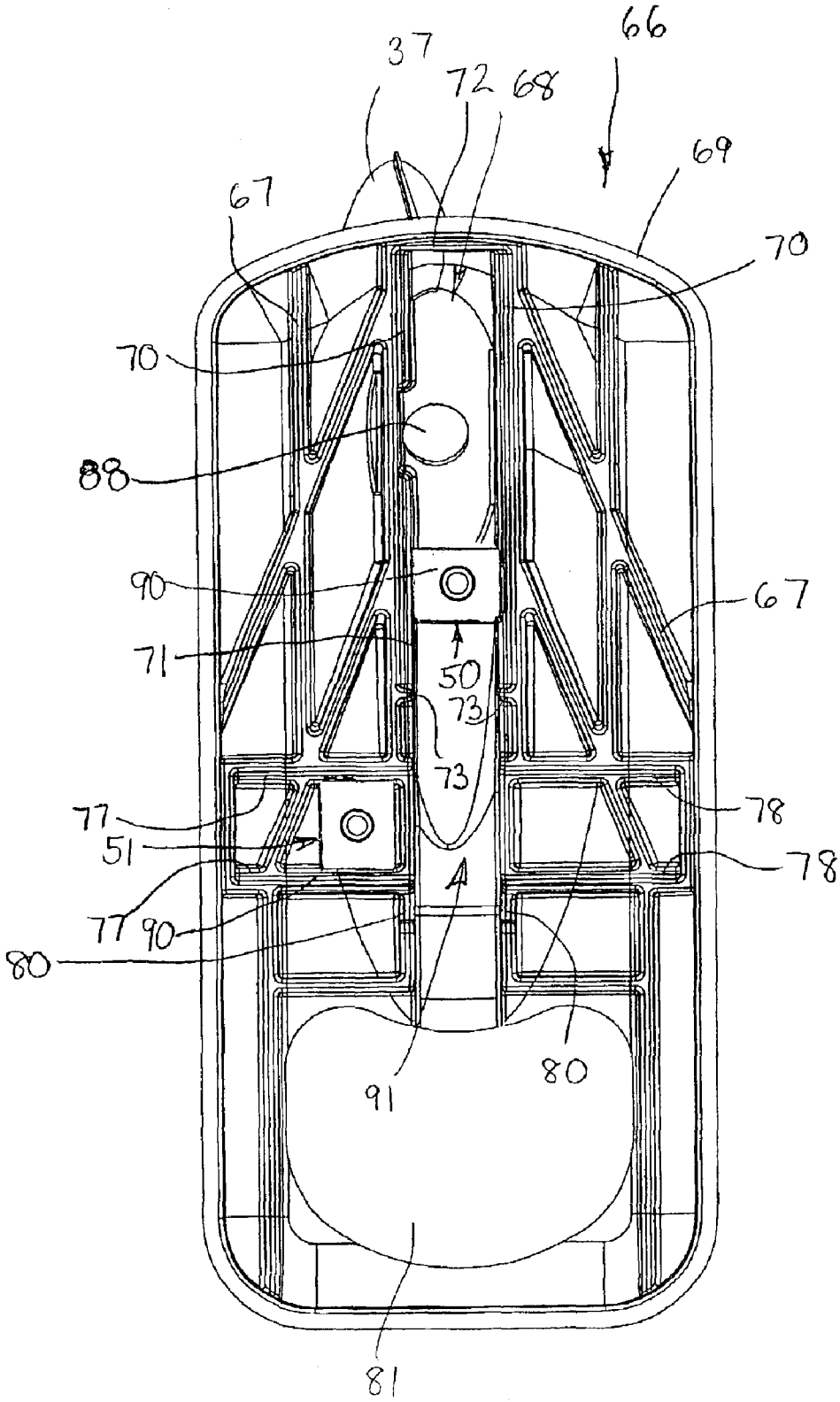
FIG. 9 is a plan view of the base housing.

Referring more particularly to the individual components of the armrest 15, the base housing 45 (FIG. 5) has a generally rectangular support section 66 which supports the weight of the armrest assembly 36. The support section 66 is formed of molded plastic material and has appropriate strengthening ribs 67 within the interior thereof. The support section 66 furthermore is molded with a central guide channel 68 which extends from the rearmost end 69 forwardly to approximately three-quarters of the overall length of the support section 66. The guide channel 68 is formed with upward facing ledges 70 and 71 wherein the ledges 70 and 71 extend from a rear wall 72 of the guide channel 68 to a pair of channel stops 73. The ledge 71 is formed by spaced apart front and rear sections 71-1 and 71-2 as seen in FIGS. 8 and 9. The longitudinal length extending between the end wall 72 and the channel stop 73 is the length of the guide channel 68 which is adapted to receive the guide pin 50, wherein the guide pin 50 is vertically supported on and slidable longitudinally along the ledges 70 and 71 between the end wall 72 and the channel stops 73.

The support section 66 further includes a transverse guide channel 75 which extends between opposite side walls 76. The guide channel 75 also is formed with support ledges 77 and 78 which extend on opposite sides of longitudinal channel 68 and are adapted to vertically support and permit horizontal transverse sliding of the second guide pin 51.

The support section 66 also includes a pair of axle supports 80 and a lever opening 81 which opens downwardly through the bottom wall of the support section 66 near the front end thereof.

When the base housing 45 has the post section 37 telescopingly received within the support tube 33 (FIG. 2), the support section 66 is effectively non-rotatable about a vertically oriented axis but instead has a fixed orientation relative to the support tube 33. The support section 66 thereby effectively defines a vertically movable but non-rotatable base for the armrest assembly 36 as described in further detail hereinafter.

To permit height adjustment of the support section 66, an actuator lever 83 is seated in the channel 68 which serves to actuate the height-adjustment mechanism 39 referenced above. The actuator lever 83 includes a horizontal lever section 84 on which a pivot axle 85 is supported wherein the opposite ends of the pivot axle 85 are pivotally received within the axle supports 80. The front end of the lever 83 includes a manually actuatable handle pad 86 which projects downwardly through the lever opening 81 to permit manual actuation by the chair occupant. The relatively narrow lever section 84 extends rearwardly and is received in the bottom of the longitudinal guide channel 68 wherein an actuator projection 87 acts downwardly through an opening 88 in the support section to effectively operate the height adjustment mechanism 39. The lever section 84 is disposed vertically below the pin ledges 70 and 71 such that the guide pin 50 is still freely slidable vertically above the lever section 84.

Figure 5:
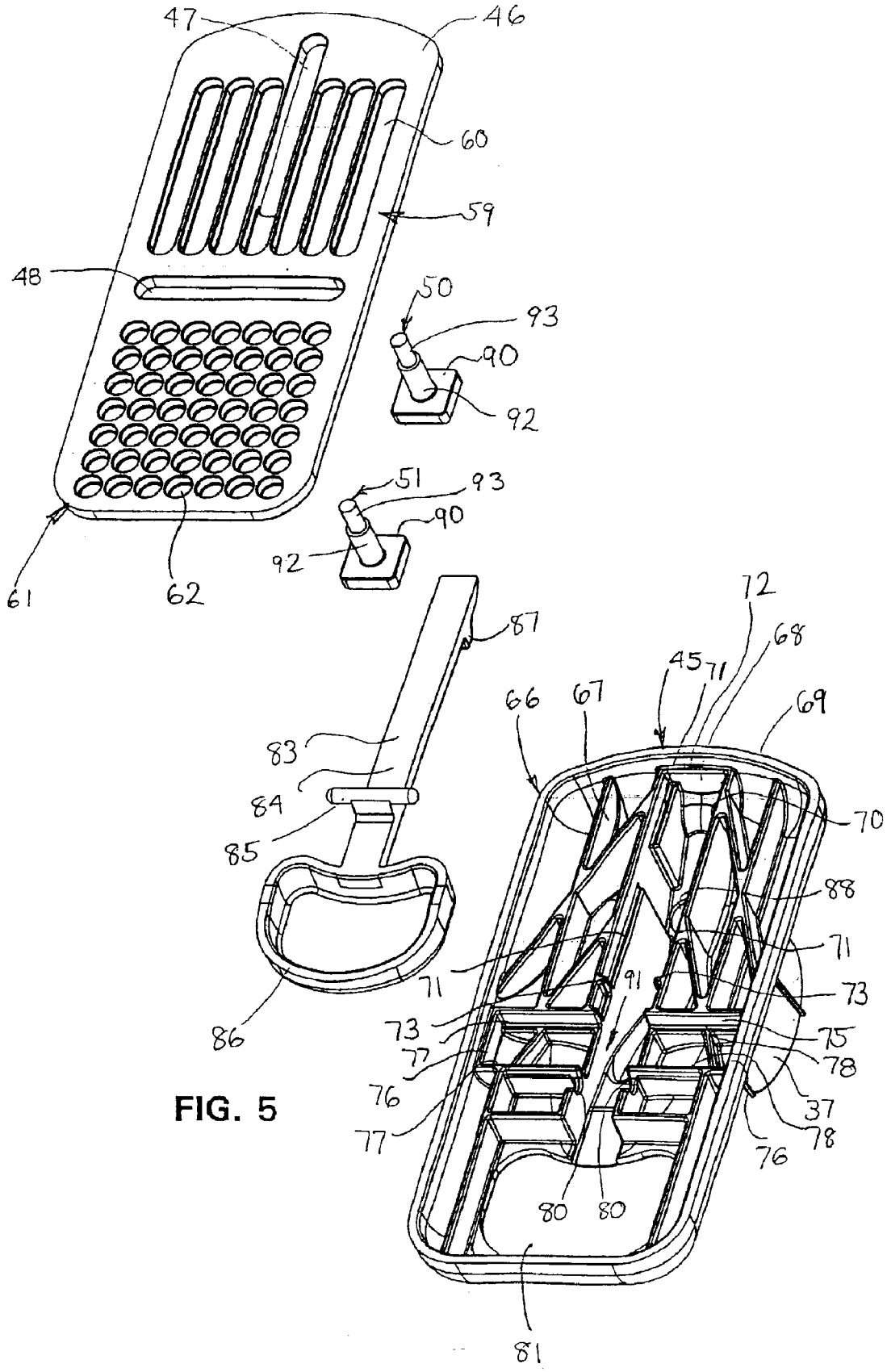
FIG. 5 is an exploded perspective view of the components of the support post.
Figure 25:
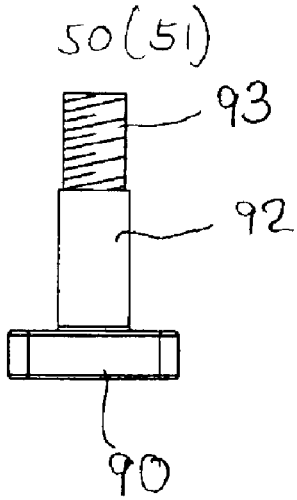
FIG. 25 is a side view of a guide pin.

Referring to FIGS. 5 and 25, each guide pin 50 or 51 is formed identical to each other and thus, common reference numerals are used herein to identify the individual features of each guide pin 50 or 51. More particularly, each guide pin 50 or 51 includes a square support block 90 on the lower end thereof which has a width which corresponds to the distance between the support ledges 70–71 or 77–78. In other words, the support blocks 90 have a width which is substantially equal to but slightly less than the width of the longitudinal guide channel 68 or the transverse guide channel 75 to permit free sliding of each guide pin 50 or 51 therealong.

Referring to FIG. 9, the guide pin 50 is shown with its support block slidably supported on the ledges 70 and 71 within the longitudinal guide channel 68. Additionally, the guide pin 51 is illustrated with its support block 90 supported on the ledges 77 although the support block 90 is able to slide across the open channel section 91 of the channel 68 in which the lever section 84 is received. As such, the guide pin 51 is freely slidable from the ledges 77 to the ledges 78 without interference by the channel section 91.

Figure 6:
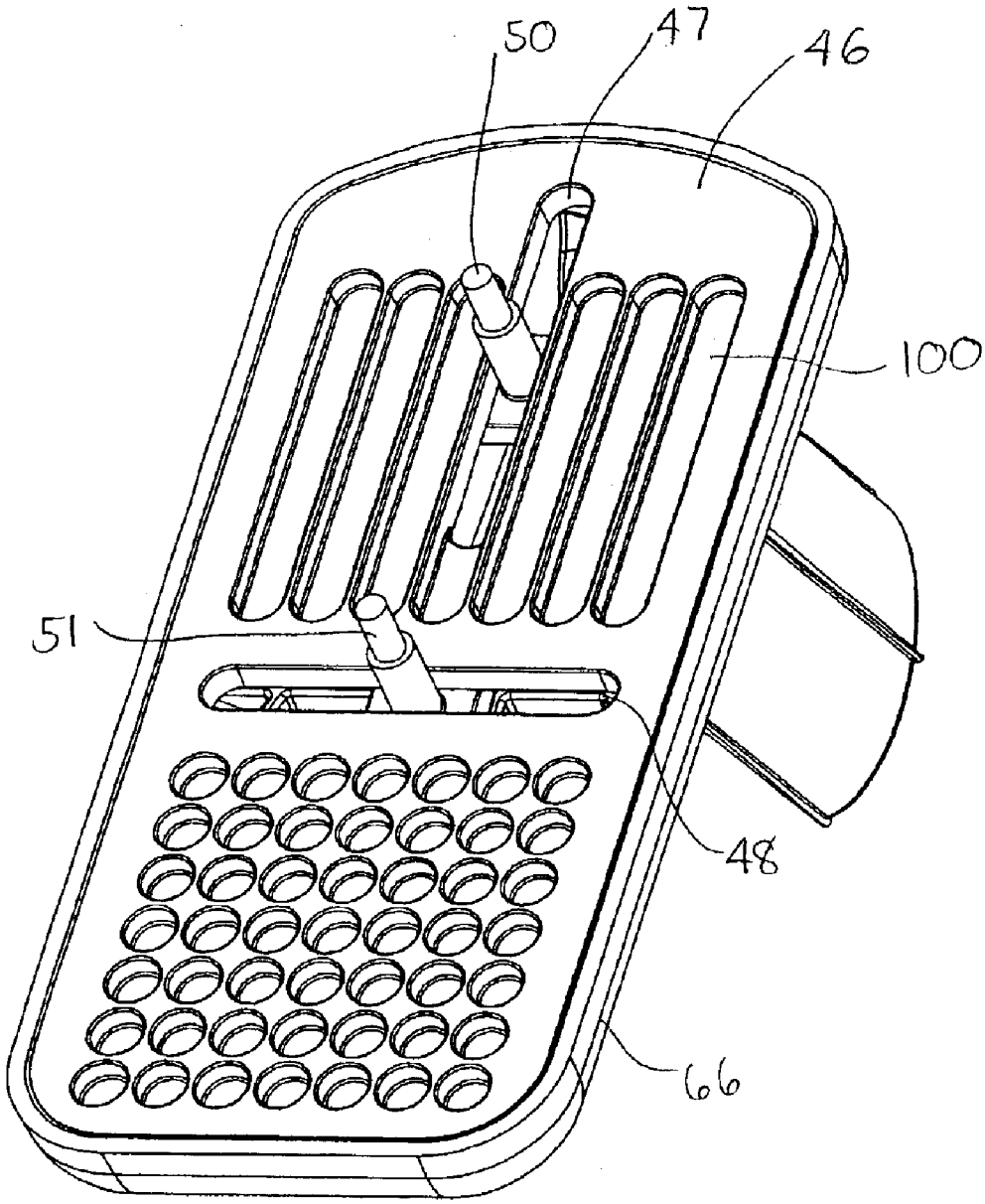
FIG. 6 is a perspective assembly view of the components of the support post with guide pins disposed in neutral positions.

Referring again to FIG. 25, the shaft of each pin 50 or 51 further includes a guide section 92 which has a cylindrical shape and projects vertically from the support block 90. The guide section 91 terminates at an upper connector section 93 at the upper end thereof which is threaded. During assembly, the guide pins 50 and 51 are first positioned within the respective guide channels 68 and 75 and then the top plate 46 is positioned within the upper end of the support section 66 and affixed in place. More particularly referring to FIG. 6, the guide pin 50 projects vertically through the longitudinal guide slot 47 while the guide pin 51 projects vertically through the transverse guide slot 48 of the top plate 46 as seen in FIG. 6.

Figure 10:
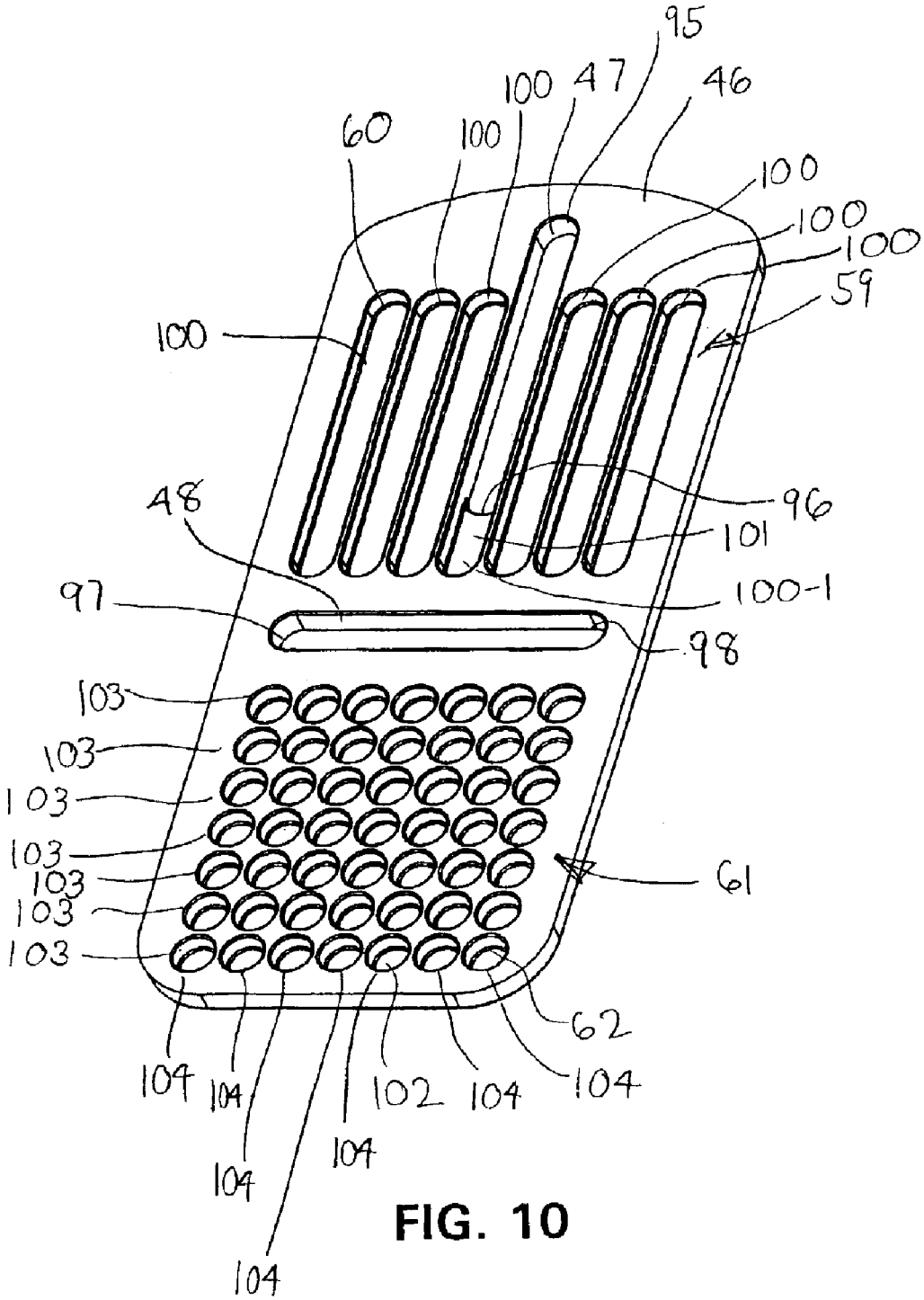
FIG. 10 is a perspective view of the top plate for the support post.

More particularly, the top plate 46 as seen in FIG. 10 is formed generally as a flat plate with the slots 47 and 48 formed so as to open vertically through the entire thickness thereof. The longitudinal slot 47 is defined by opposite ends 95 and 96, while the transverse slot 48 is defined by opposite ends 97 and 98. The longitudinal slot 47 is oriented transverse to and generally perpendicular to the transverse slot 48 and the front slot end 96 thereof is longitudinally spaced apart from the transverse slot 48.

Additionally, a first pattern 59 of uni-directional locking formations 60 is provided in the region of the longitudinal slot 47. More particularly, the uni-directional locking formations 60 preferably are formed as spaced apart, longitudinally elongate slots 100 which extend generally parallel to each other and have equal longitudinal lengths. The centermost slot 100-1 has a shallow depth near the front end 101 thereof like slots 100 and then opens into the guide slot 47. As described in further detail herein, these locking slots 100 are adapted to engage the rearmost locking pin 56 and confine this locking pin 56 only in the transverse direction, hence reference to the locking formation 60 is being uni-directional. In other words, the locking pin 56 is unrestrained in the longitudinal direction.

As to the second pattern 61 of bi-directional locking formations 62, these locking formations 62 preferably are formed as circular holes or apertures 102 which are arranged in parallel transverse rows 103 and in longitudinally elongate columns 104. The holes 102 are arranged in a checkerboard-like grid. These holes 102 are adapted to receive the frontmost locking pin 57 therein and thereby restrain the locking pin 57 both in the transverse and longitudinal directions, hence identification of the holes 102 as bi-directional.

Referring to FIG. 6, when the top plate 46 is fitted within the support section 66, the locking holes 102 and locking slots 100 open upwardly while the guide pins 50 and 51 project vertically through the guide slots 47 and 48. Once assembled, the pins 50 and 51 are freely slidable horizontally along the slots 47 and 48 as illustrated generally in FIG. 7.

Figure 7:
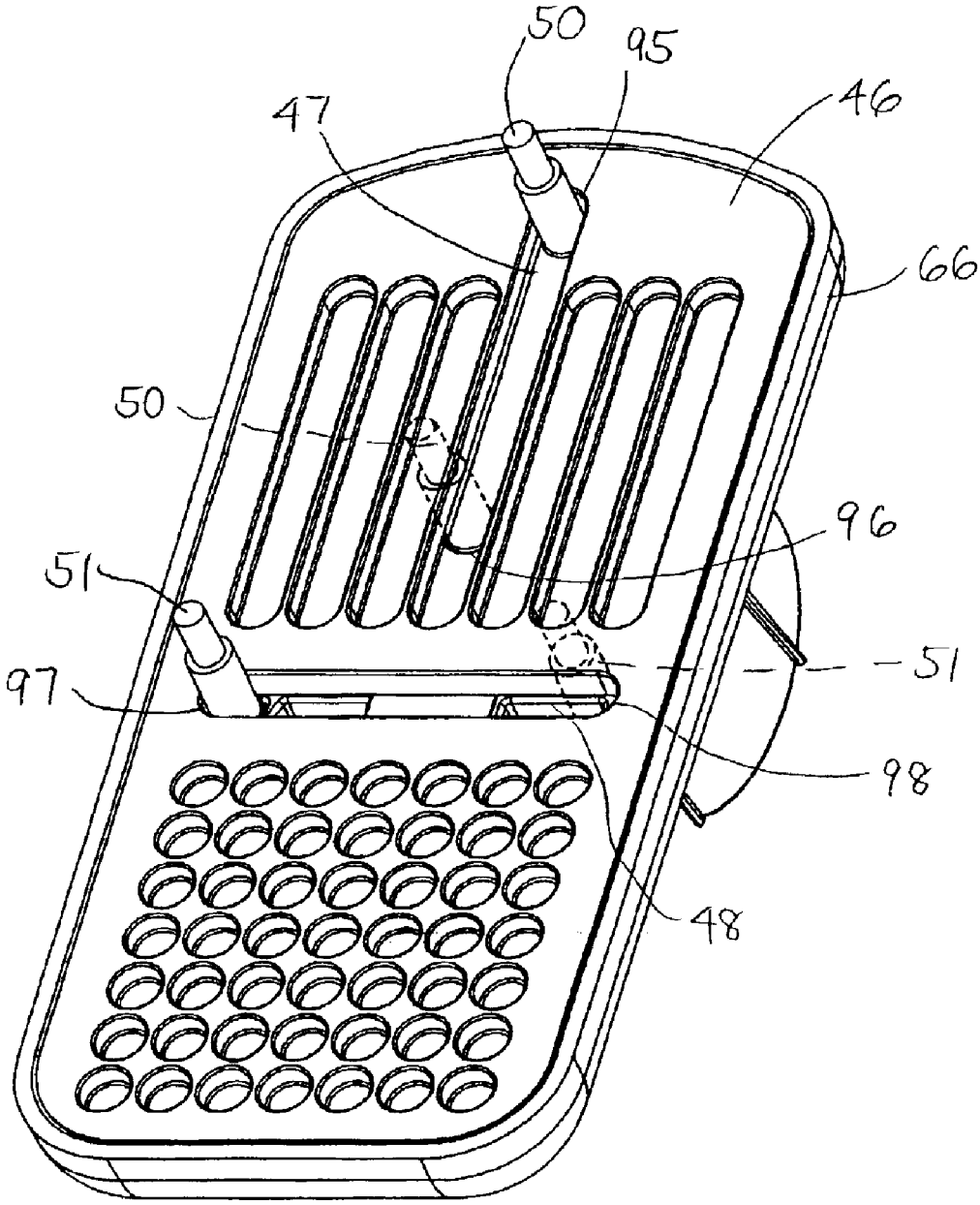
FIG. 7 is a perspective view of the support post of FIG. 6 with the guide pins illustrated at one end of their range of travel in solid outline and at an opposite end of their range of travel in phantom outline.

For example, the guide pins 50 and 51 are illustrated in an intermediate center position within their respective slots 47 and 48 (FIG. 6) but may be slid to the opposite ends of the slots 47 and 48 (FIG. 7). As seen in FIG. 7, the pin 50 is located at the rear slot end 95 as illustrated in solid outline but is movable forwardly to the front slot end 96 as illustrated in phantom outline. Similarly, the locking pin 51 is movable transversely or sidewardly to the slot end 97 as illustrated in solid outline but is freely slidable to the opposite slot end 98 as illustrated in phantom outline.

More particularly as to the armrest housing 41 (FIGS. 17 and 18), this housing 41 has a bottom wall 106 rigidly formed with a peripheral side wall 107 and a peripheral flange 108 extending thereabout. The bottom wall 106 is formed with the transverse slot 52 in the region of the back end 110 of the housing 41 while the longitudinal slot 53 is formed in an intermediate region 111 of the housing 41 disposed forwardly of the back end section 110. The transverse slot 52 extends sidewardly or transversely between opposite slot ends 112 and 113 while the longitudinal slot 53 extends longitudinally between opposite rear and front ends 114 and 115. The longitudinal spacing between the slots 52 and 53 is substantially identical to the slots 47 and 48 except that, after assembly, the transverse armrest slot 52 is located vertically above and oriented transverse to the longitudinal base slot 47 associated therewith. Additionally, the longitudinal armrest slot 53 is oriented in transverse relation and preferably perpendicular to the longitudinal base slot 48. The slots 47 and 52 and the slots 48 and 53 thereby form associated pairs of slots wherein each pair, such as the slots 47 and 52, are adapted to receive therethrough one of the guide pins, such as the guide pin 50. Additionally, the remaining pair of slots 53 and 48 align with and are adapted to receive the associated guide pin 51. The cooperation of these guide slots and guide pins permits the armrest assembly 36 illustrated diagrammatically in FIGS. 11–16 to move in the transverse, longitudinal and/or angular directions.

Figure 23:
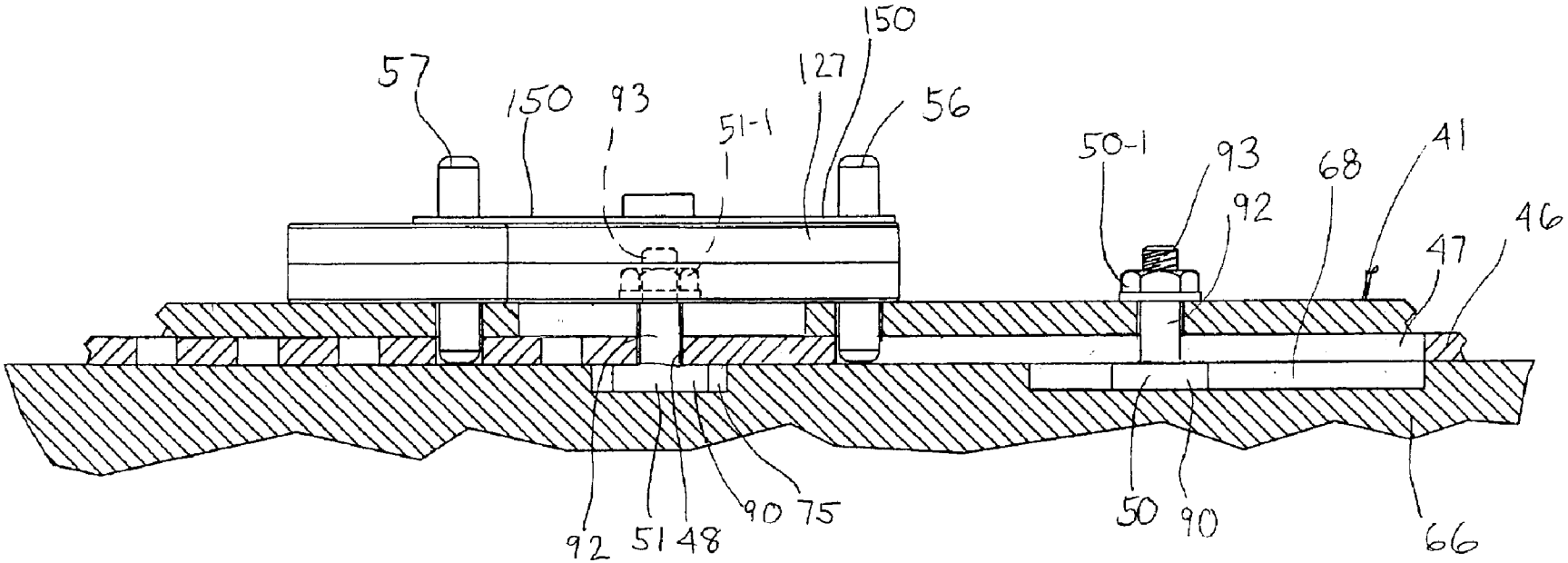
FIG. 23 is a side cross-sectional view of the actuator assembly as taken along lines 23—23 of FIG. 19.

During assembly, the support section 66 already is assembled together as illustrated in FIGS. 4 and 6 wherein the pins 50 and 51 project vertically upwardly. Thereafter, the armrest housing 41 is fitted downwardly onto the top plate 46 with the pins 50 and 51 projecting vertically through the slots 52 and 53 as generally illustrated in FIG. 23. Thereafter, threaded nuts 50-1 and 51-1 are threaded onto the threaded end sections 93 of the respective pins 50 and 51 to fixedly secure the armrest housing 41 in place while permitting sliding movement of the armrest housing 41 relative to the top plate 46.

Figure 11:
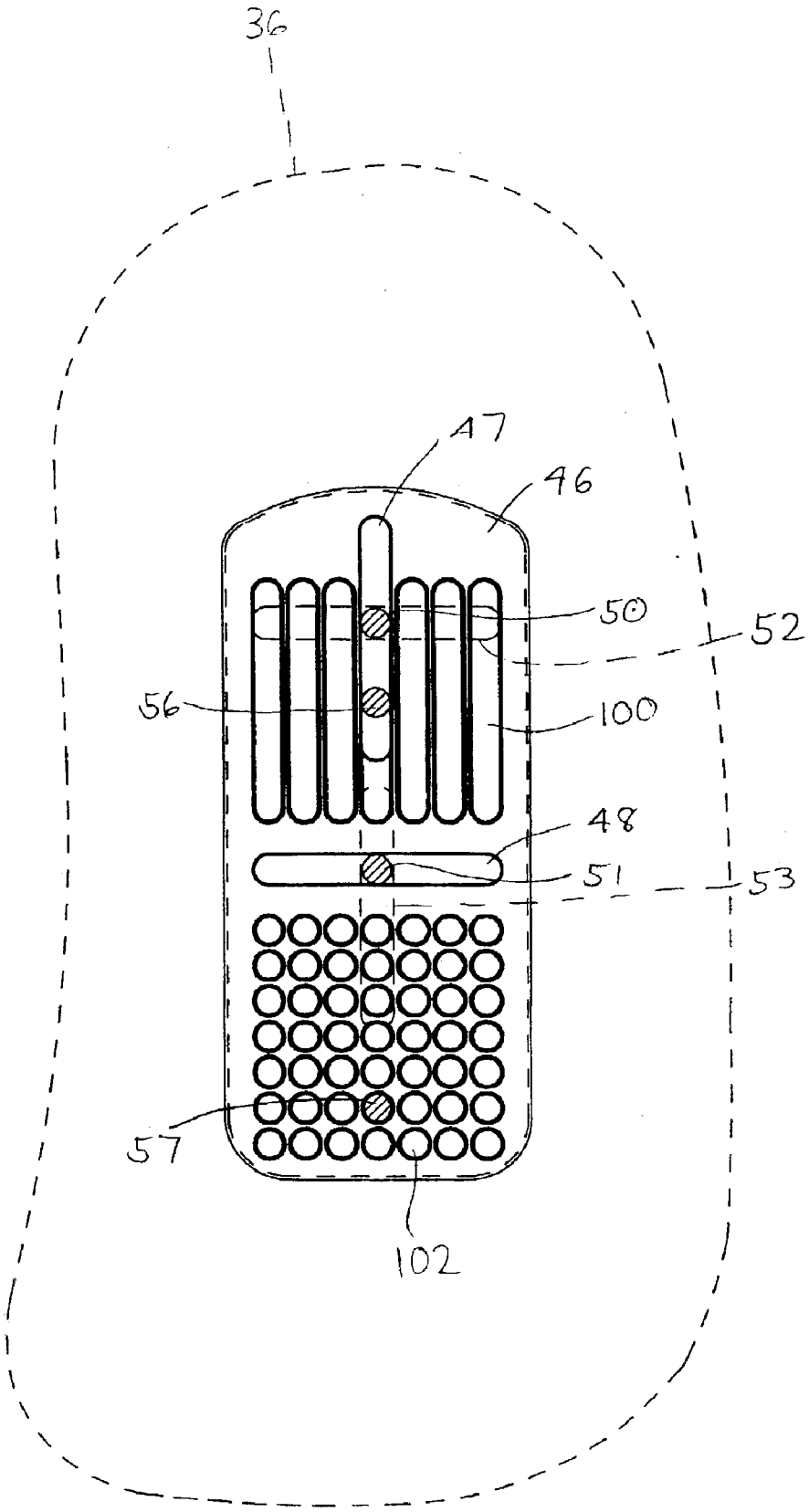
FIG. 11 is a plan view of the top plate and base housing with the guide pins illustrated therein and locking pins also illustrated wherein an armrest is illustrated in phantom outline in an initial position.

Referring to FIG. 11, the pin 50 is confined sidewardly in the base guide slot 47 but is slidable longitudinally along the length thereof. Since the pin 50 also is confined in the longitudinal direction in the armrest slot 52 on the armrest assembly 36, the intersection point of the slots 47 and 52 thereby governs the location of the pin 50 longitudinally within the slot 47 and transversely within the slot 52. Similarly as to the slots 48 and 53, the intersection of the base slot 48 and armrest slot 53 defines the position of the pin 51 in the armrest slot 53.

To illustrate the movements of the pins 50 and 51 during movement of the armrest assembly 36, FIGS. 11–16 illustrate various representative positions for the armrest assembly 36 and the resulting positions in which the pins 50 and 51. FIG. 11 illustrates the armrest assembly 36 at a neutral position with the guide pins 50 and 51 located at the midpoints of each of the slots 47, 48, 52 and 53.

Figure 12:
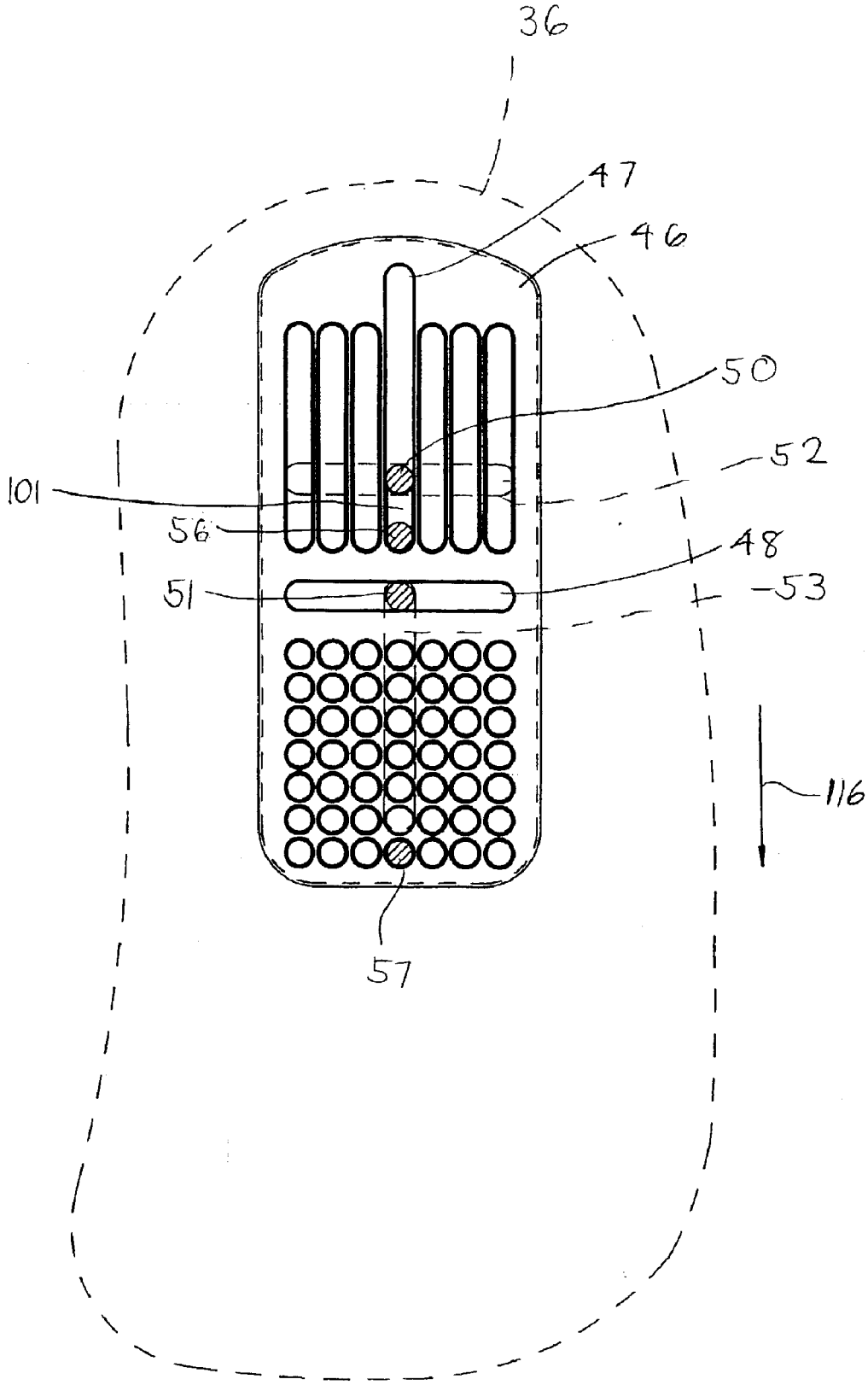
FIG. 12 is a plan view illustrating the guide pins and locking pins with the armrest in a forwardly displaced position.

As seen in FIG. 12, the armrest assembly 36 is moved forwardly to its forwardmost position as diagrammatically illustrated by reference arrow 116. Forward movement of the armrest housing 36 causes the armrest slot 52 to pull the pin 50 forwardly along the longitudinal base slot 47. The other pin 51 however is restrained longitudinally in base slot 48 but instead the armrest slot 53 moves relative to the pin 51.

Figure 13:
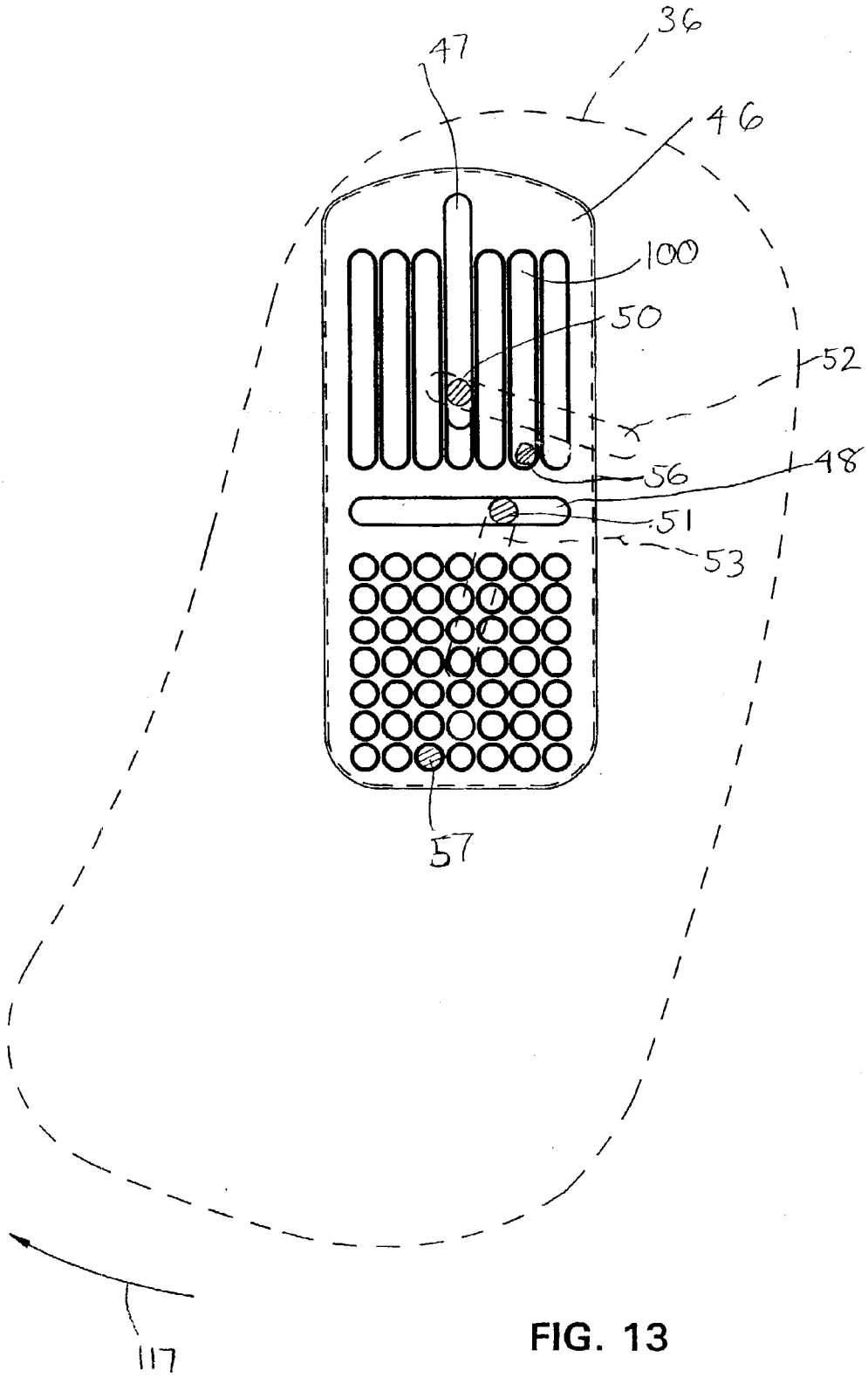
FIG. 13 is a plan view illustrating the guide pins and locking pins with the armrest in a forwardly and angularly inwardly displaced position.

Referring to FIG. 13, once the armrest assembly 36 is in the forwardmost position, the front end of the armrest assembly 36 may be swung inwardly as indicated by reference arrow 117 to a new inwardly oriented angular position. As a result of this specific angular repositioning, the armrest slot 52 moves rightwardly along the pin 50 and while pin 51 is pushed rightwardly along the transverse base slot 48 by armrest slot 53.

Figure 14:
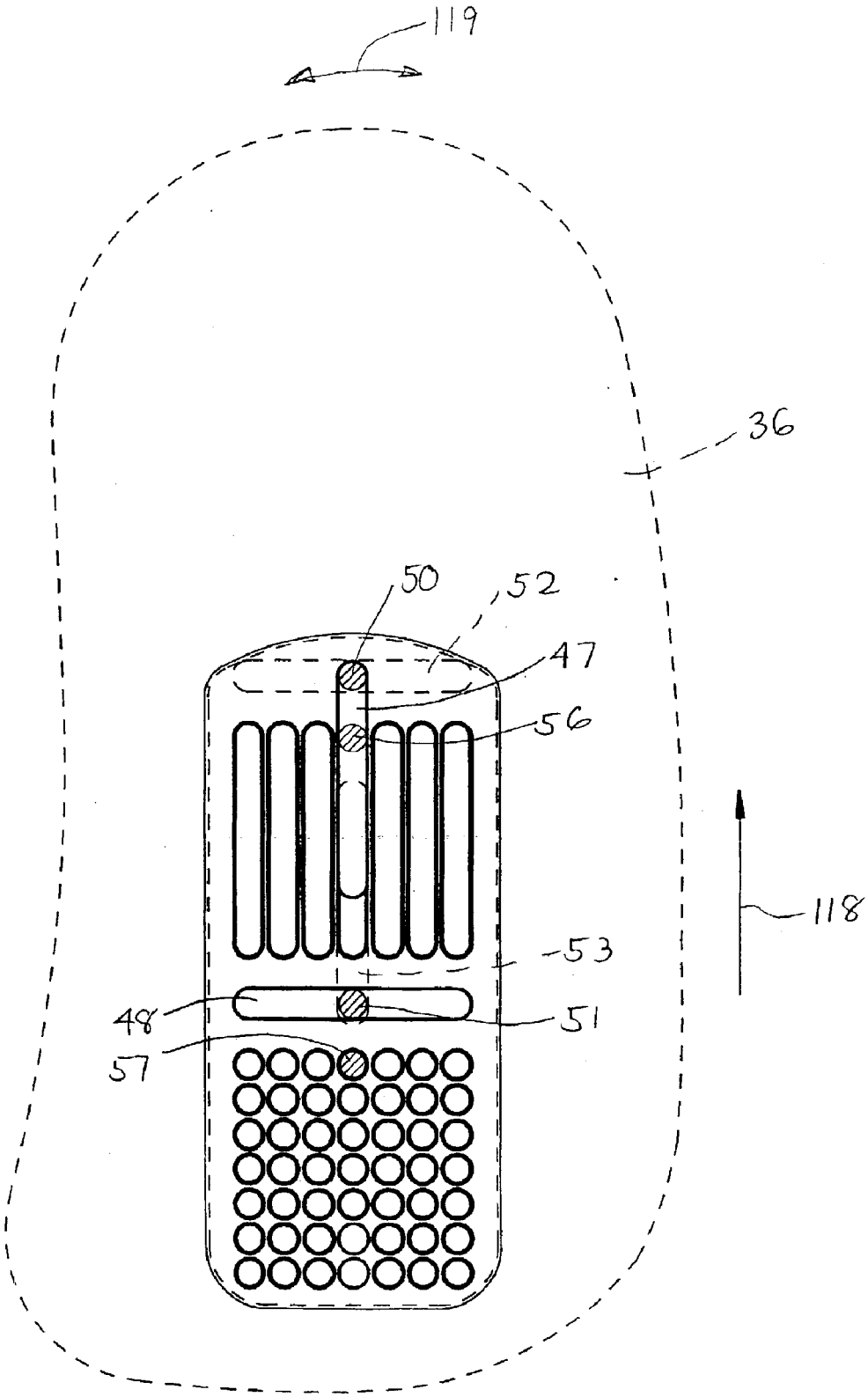
FIG. 14 is a plan view illustrating the armrest in a rearwardly displaced position.

Alternatively as seen in FIG. 14, the armrest assembly 36 may be slid rearwardly such that the guide pin 50 is pushed to the end of the longitudinal base slot 47 by the armrest slot 52 so as to be located at the forwardmost end of the longitudinal armrest slot 53. The armrest housing 36 also may be swung either angularly inwardly or outwardly as indicated by reference arrow 19 similar to the movement of FIG. 15.

Figure 15:
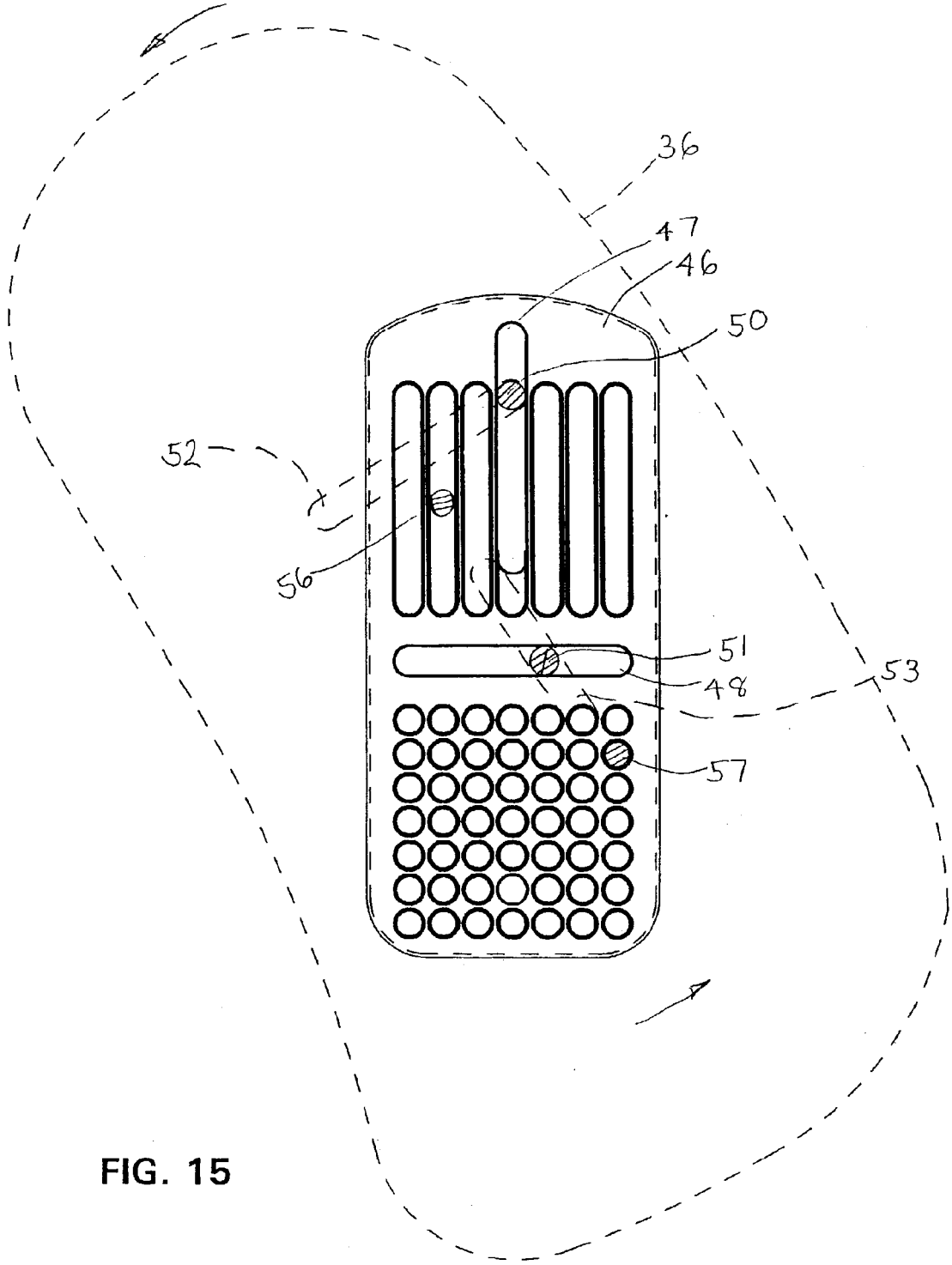
FIG. 15 is a plan view illustrating the armrest in a rearwardly and angularly inwardly displaced position.

In another example illustrated in FIG. 15, the armrest housing 36 may be located somewhere intermediate the forwardmost position of FIG. 12 and the rearmost position of FIG. 14 and when in this intermediate location then displaced angularly. This angular displacement of FIG. 15 occurs by rotating the back end of the armrest housing 36 inwardly while also rotating the forward end of the armrest housing 36 outwardly. As a result, the pin 50 is located at the outer end of the transverse armrest slot 52 to thereby limit further inward displacement of the armrest housing 36. However, the front pin 51 is still located between the opposite ends of both slots 48 and 53 such that additional inward or outward angular movement of the front end of the armrest housing 36 is still permitted.

Figure 16:
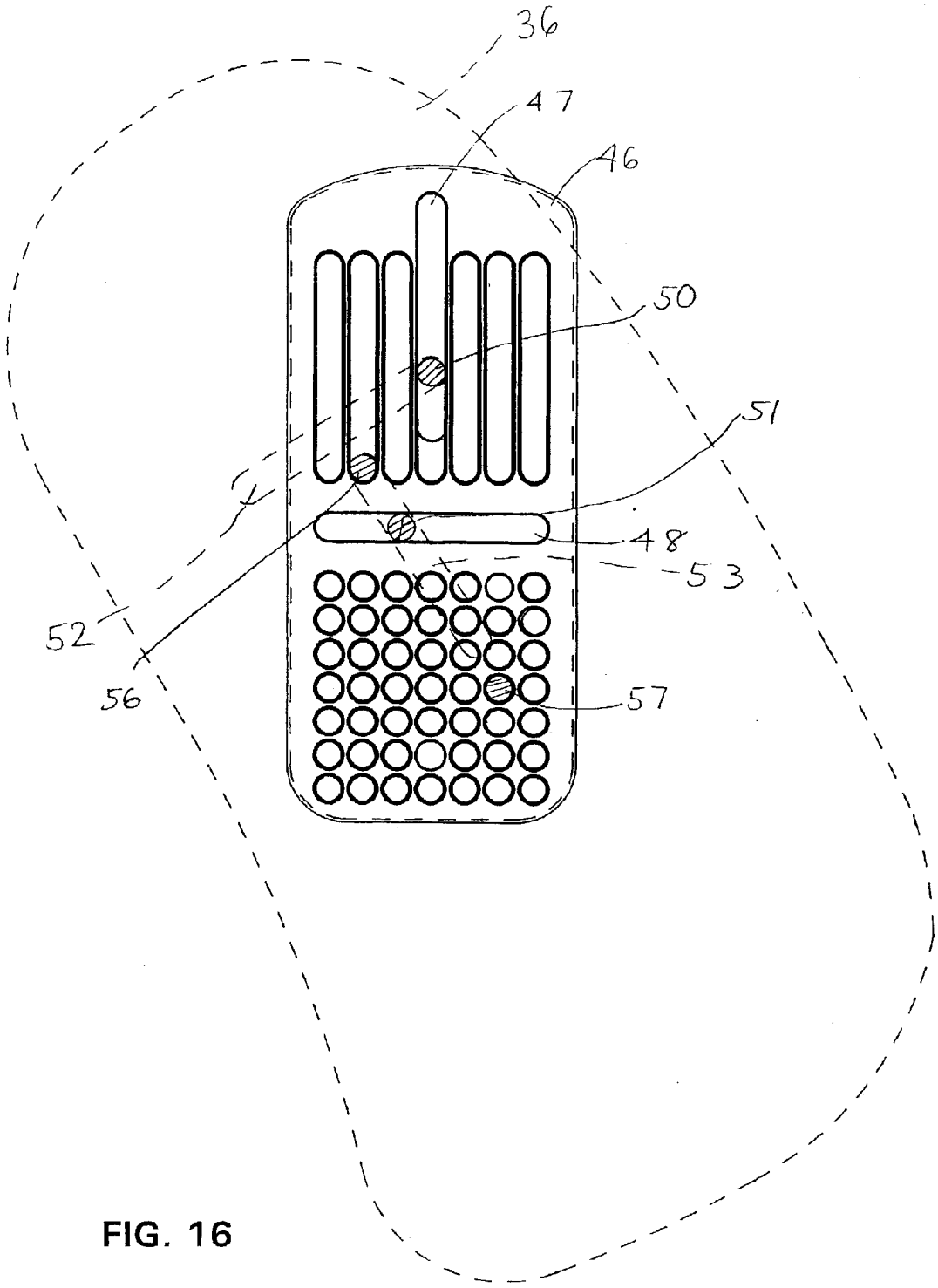
FIG. 16 is a plan view illustrating the armrest in a forwardly and angularly outwardly displaced position.

Referring to FIG. 16, in the same relative angular position of FIG. 15, the armrest housing 36 may be slid forwardly without changing the angular orientation thereof. As this occurs, the rear guide pin 50 remains at the outer end of the transverse armrest slot 52. However, the front guide pin 51 automatically slides inwardly along the slot 48 as the longitudinal armrest slot 53 is displaced forwardly.

The armrest housing 36 may be moved through practically any other position beyond those examples illustrated in the prior figures. In particular, the armrest housing 36 may be moved directly sidewardly such as when in the position of FIG. 11 wherein the pins 50 and 51 slide sidewardly along the transverse slots 52 and 48. The drawings already depict that the armrest housing 36 may be moved forwardly or rearwardly and may be angularly tilted in any stationary position or may be further moved forwardly or rearwardly even when in an angularly displaced position. The cooperating slots and guide pins thereby provide a highly flexible repositionable armrest housing 36.

In addition to the foregoing flexibility and positioning of the armrest housing 36, the chair arm 12 further includes the locking arrangement 42 which is readily lockable through any of the numerous angular positions permitted by the foregoing slot and pin arrangement. This locking arrangement 42 includes, as part thereof, the first pattern 59 of uni-directional locking formations 60 and the second pattern 61 of the bi-directional locking formations 62.

Figure 17:
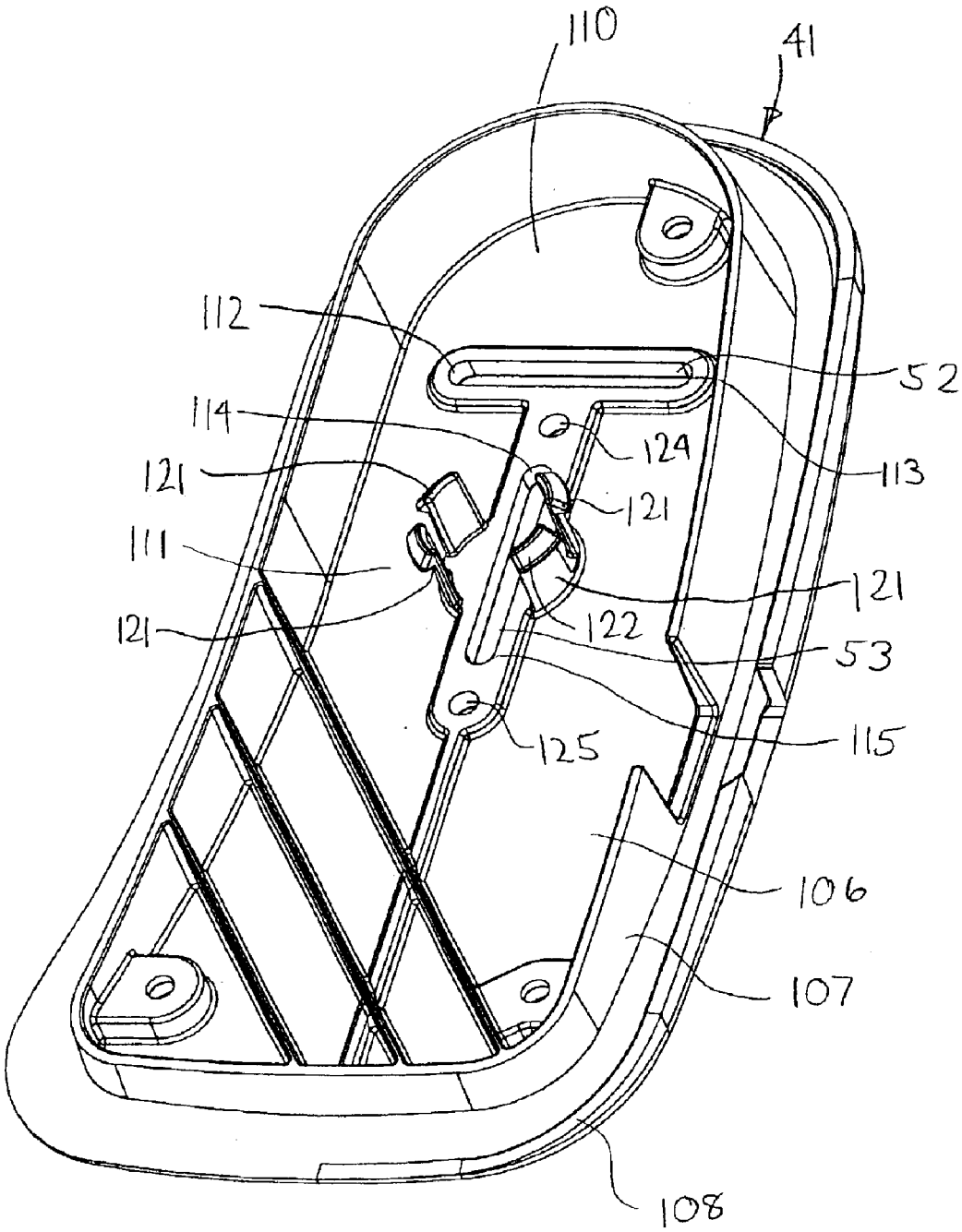
FIG. 17 is a perspective view of an armrest housing.
Figure 18:
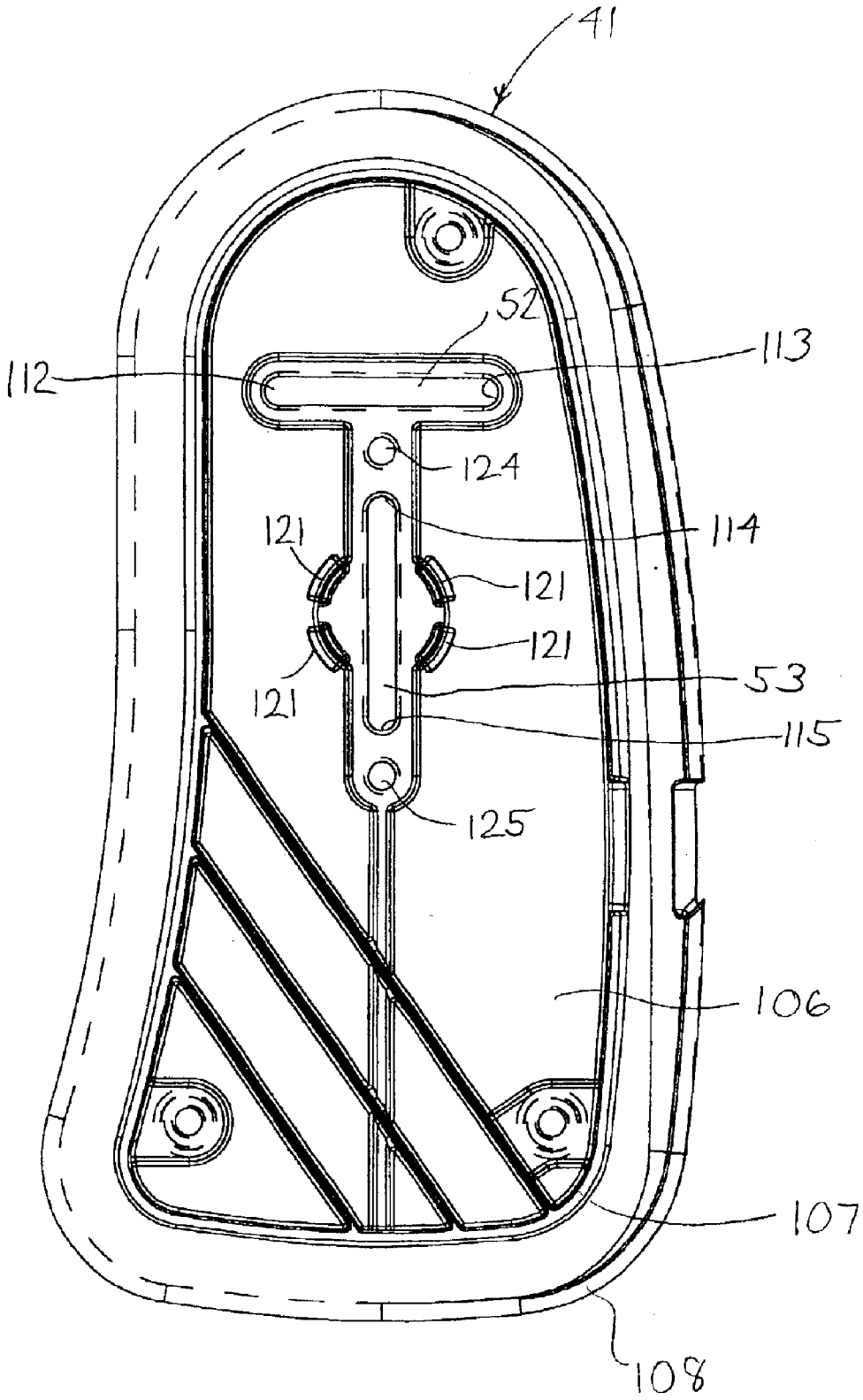
FIG. 18 is a plan view of the armrest housing.

The locking arrangement 42 further includes an actuator mechanism 120 to effect engagement and disengagement of the locking pins 56 and 57. To support the actuator mechanism 120, the armrest housing 41 includes mounting flanges 121 as seen in FIG. 17 which project upwardly and support the actuator mechanism 120 within the housing 41. More particularly, four mounting flanges 121 are provided, two on each opposite side of the longitudinal armrest slot 53. The mounting flanges 121 are disposed in cantilevered relation on the bottom housing wall 106 and are resiliently deflectable radially inwardly. The upper ends of each flange 121 include an inclined lip 122 that defines a snap-fit connection as described in further detail herein. Further, the bottom wall 106 includes pin holes 124 and 125 which are adapted to receive the locking pins 56 and 57 respectively. The rear pin hole 124 is disposed midway between the transverse slot 52 and the longitudinal slot 53, while the other front pin hole 125 is spaced forwardly of the front end 115 of the slot 53.

Figure 19:
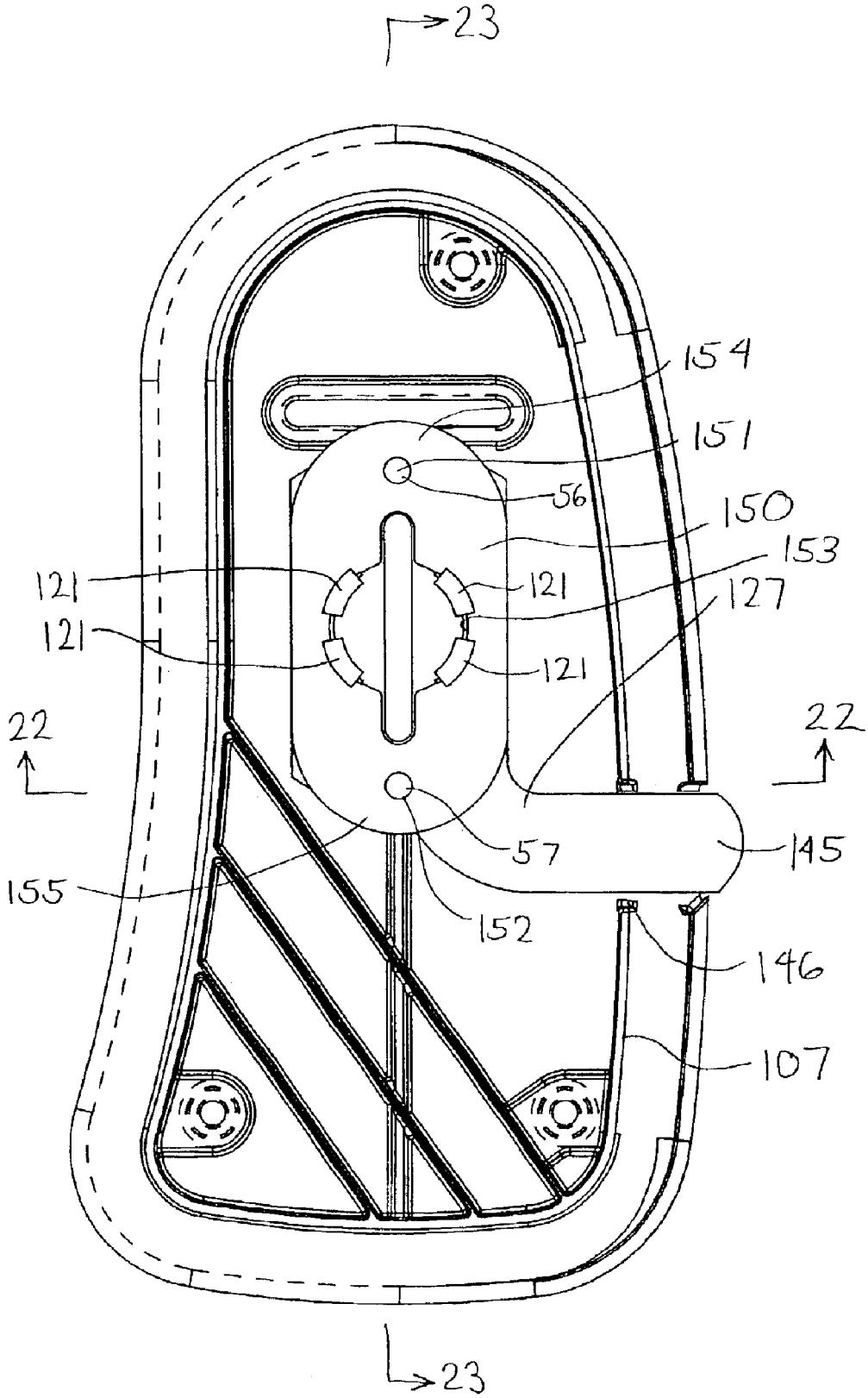
FIG. 19 is a plan view of the armrest housing with the actuator mounted therein.
Figure 20:
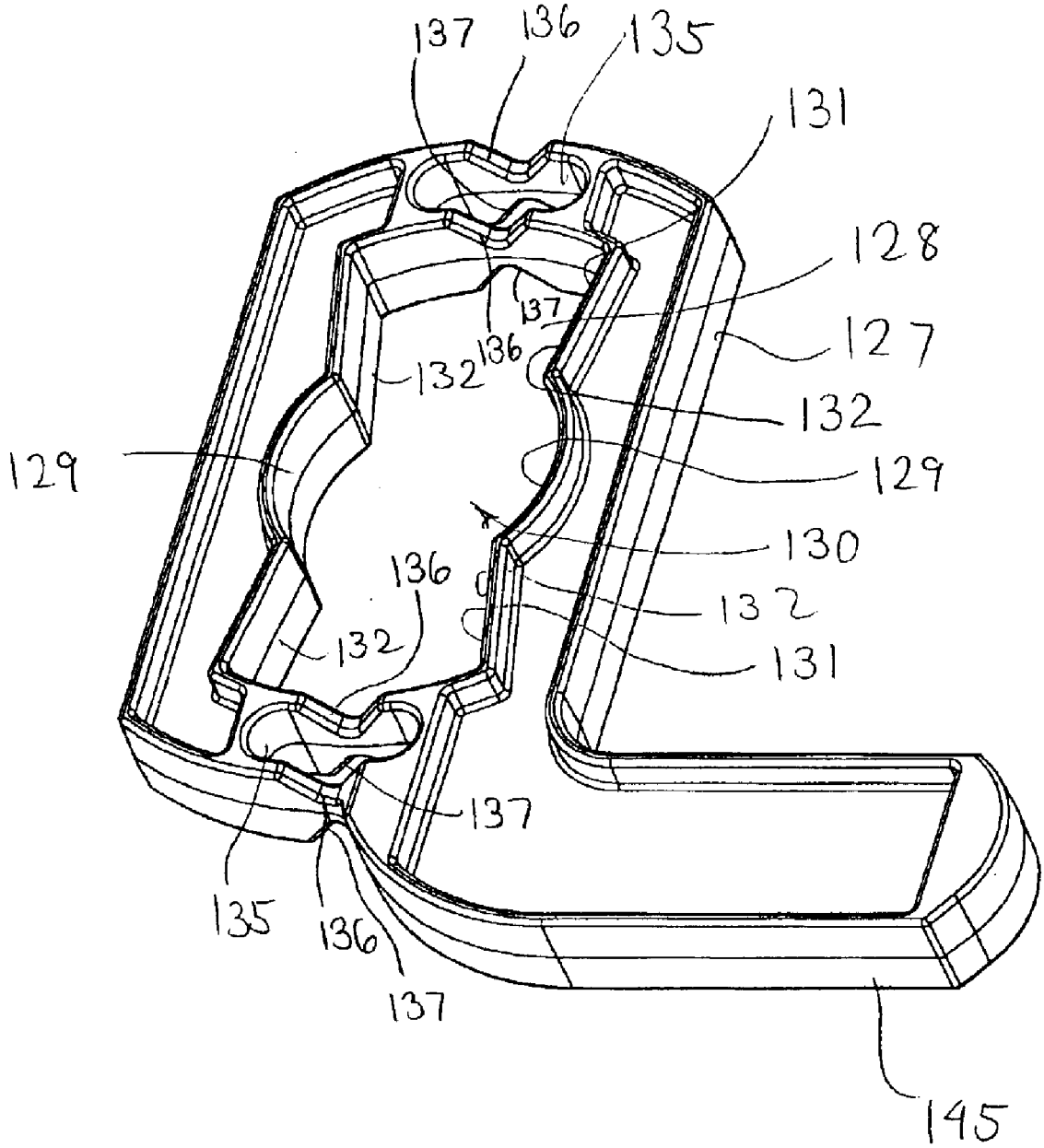
FIG. 20 is a perspective view of an actuator handle.
Figure 21:
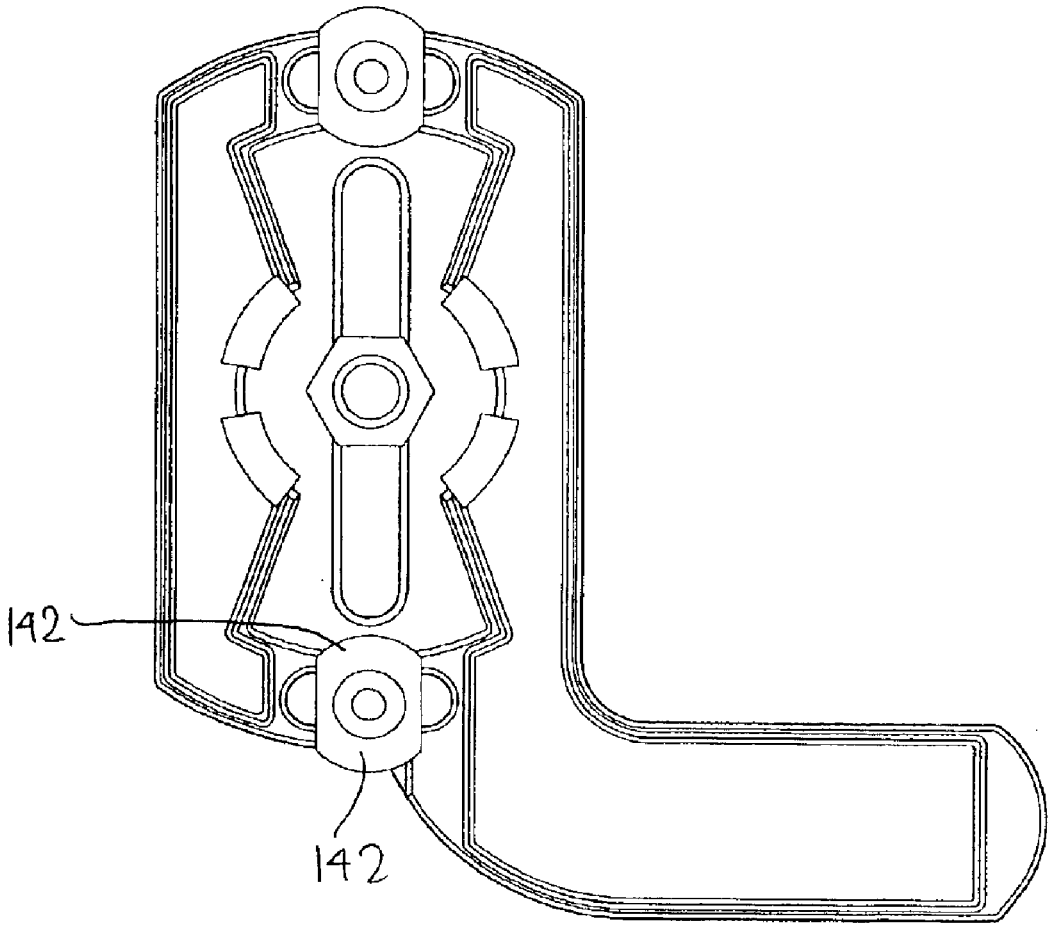
FIG. 21 is a plan view of the actuator assembly.
Figure 22:
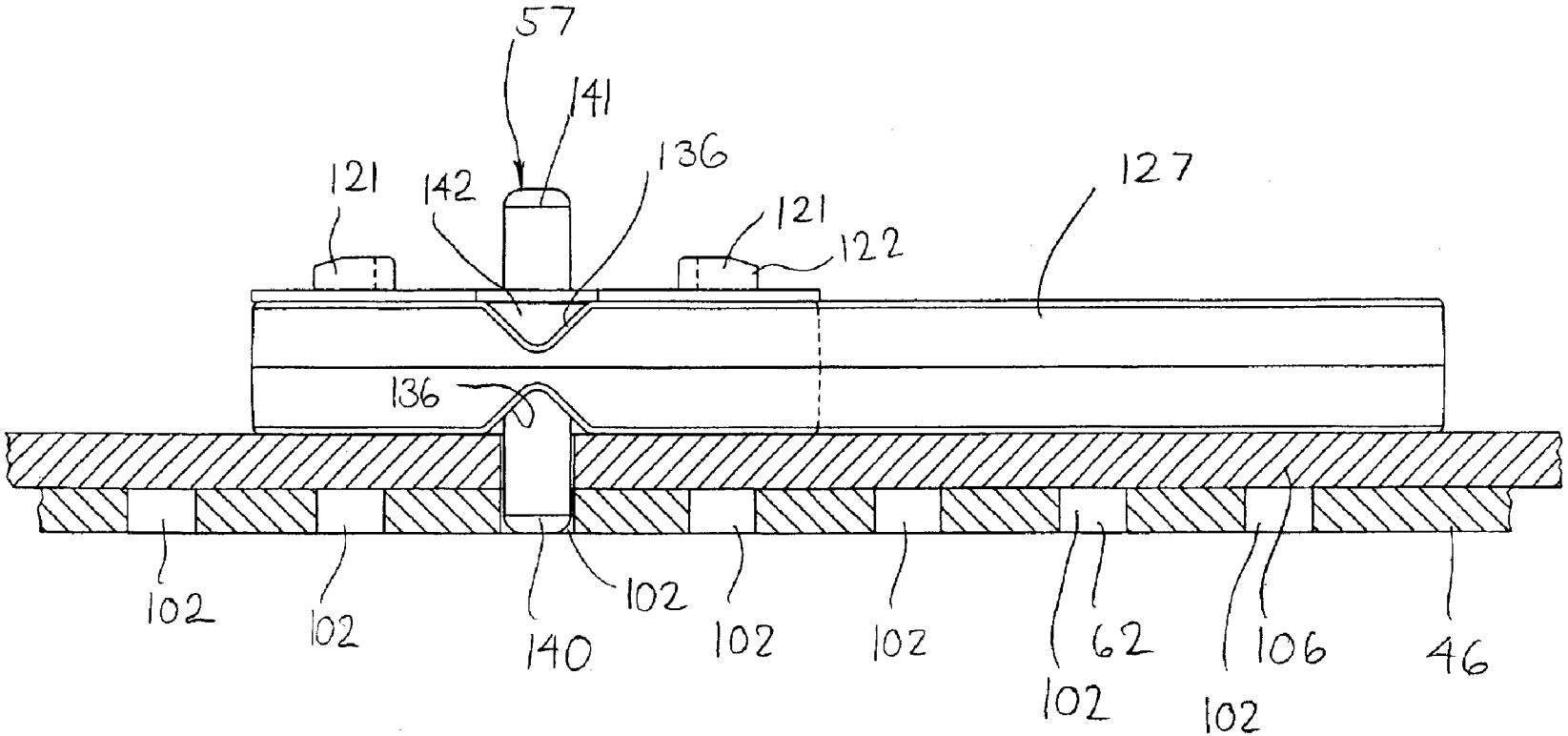
FIG. 22 is a side cross-sectional view of the actuator assembly as taken along lines 22—22 of FIG. 19.

Referring to FIGS. 19, 20 and 22, the actuator mechanism 120 also includes a rotatable lever 127 which snaps onto the mounting flanges 121 and rotate about a vertical axis. In particular, the lever 127 is formed with an elongate opening 128 in the middle thereof. The opening 128 includes semicircular wall sections 129 in the center area thereof which effectively define a circular opening 130 through which the mounting flanges 120 are fitted. The cooperating flanges 121 and wall sections 129 are all arcuate so as to permit rotation of the lever 127 in a horizontal plane. The opposite ends of the central open area 128 also include generally trapezoidal extensions 131 defined by radially diverging side walls 132. These end sections 131 provide clearance space to permit the nuts 50-1 to slide longitudinally therealong without interference with the actuator lever 127.

The opposite ends of the lever 127 also include circumferentially arcuate pin slots 135 which are adapted to receive a respective one of the locking pins 56 or 57 vertically therethrough. Additionally, the lever 127 includes upper V-shaped cam notches 136 extending along the opposite sides of the pin slot 135. Additional pairs of cam notches 137 are formed on the lower side of the actuator. As such, the same actuator lever 127 may be used in either the right chair arm 12 or the left chair arm 12 merely by flipping the lever 127 over.

Figure 24:
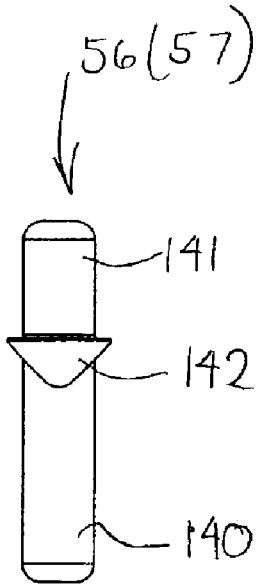
FIG. 24 is a side view of a locking pin.

Referring now to FIG. 24 and the locking pins 56 or 57 illustrated therein, these locking pins 56 or 57 are formed identical to each other with a lower locking section 140, an upper projection 141 and V-shaped radial cam projections 142 which project radially from opposite sides of the pins 56 or 57. Referring to FIG. 22, each of the pins 56 and 57 is slid through a respective one of the pin slots 135, wherein the radially projecting cam sections 142 seat downwardly within the pair of V-shaped cam notches 136. The lower pin sections 140 project through the bottom wall 106 of the armrest housing and into selected engagement with one of the holes 102 or the slots 100.

The lever 127 also includes an actuator button 145 which projects outwardly through a square cutout 146 formed through the housing side wall 107. The button 145 is pressed manually inwards which causes rotation of the lever 127 wherein rotation of the lever 127 causes the pin cams 142 to slide upwardly along the corresponding cam notches 136. The simultaneous upward movement of the pins 56 and 57 thereby pulls the lower pin section 140 vertically out of the corresponding hole 102 or locking slot 100. As such, pressing the button 145 inwardly disengages the locking pins 56 and 57 vertically upwardly out of the holes 102 or slots 100.

To generate a restoring force to the pins 56 and 57, a resilient spring plate 150 is fitted onto the top of the lever 127 in a sandwich-type relationship. The spring plate 150 includes holes 151 and 152 which receive the pins 56 and 57 vertically therethrough. The spring plate 150 has a generally circular opening 153 which is sized slightly larger than the connector flanges 121 so that the spring plate 150 also snaps on top of the upper surface of the actuator lever 127 and is sandwiched between the lip 122 and the lever 127. Therefore, rotation of the lever 127 lifts the pins 56 and 57 which is permitted because the opposite ends 154 and 155 of the spring plate 150 are able to bend vertically upwardly. However, the spring plate 150 is resilient so as to continuously bias the pins 56 and 57 downwardly. Upon releasing the lever 127, the cooperating cams 142 and 136 permit the pins 56 and 57 to re-engage with the locking formations 60 or 62.

Referring now to FIGS. 11–16, the locking pins 56 and 57 in operation are disposed in a fixed relationship relative to the transverse armrest slot 52 and the longitudinal armrest slot 53 due to the fixed location of the pin holes 124 and 125. These fixed positions are located so that the locking pin 56 engages one of the slots 100 while the pin 57 engages one of the holes 102 regardless of the angular orientation of the armrest 36. For example, the bi-directional hole 102 in FIG. 11 restricts movement of the front end of the armrest housing 36 both laterally and longitudinally. The slots 100, however, only restrain the locking pin 56 laterally. When the pins 56 and 57 are in their engaged position as generally seen in FIG. 11, the armrest housing 36 is unable to move longitudinally, laterally or angularly.

After rotation of the lever 127, the spring plate 150 described above is able to deflect and allow the pins 56 and 57 to be disengaged which allows for free movement of the armrest housing 36 through the various exemplary positions illustrated in FIGS. 12–16. However, once the armrest housing 36 is positioned in any desired location such as those illustrated in FIGS. 12–16, the lever 127 is released wherein the spring plate 150 causes the pins 56 and 57 to be biased downwardly back into engagement with appropriate slots or openings.

In FIG. 12, the front pin 57 engages a selected one of holes 102 while the rear pin 56 engages the center slot 100-1 near the front portion 101. In FIG. 13, the locking pin 56 is displaced rightwardly to a different slot 100 while the other locking pin 57 moves to another different hole 102. FIG. 14 illustrates a different arrangement while FIG. 15 illustrates the locking pin 56 displaced to one of the leftward slots. If the pins 56 or 57 are slightly misaligned relative to the openings 102 or slots 100, the armrest housing 36 is still able to displace itself slightly sidewardly so as to effect proper alignment and re-engagement of the locking pins 56 and 57.

With this arrangement, an armrest housing 36 has a high degree of adjustability and the locking mechanism 42 is readily engageable in any of the longitudinally, laterally or angularly displaced positions.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A chair having an adjustable body support assembly comprising:

a base component supported on said chair; and a support body having an enlarged support surface for supporting the body of a chair occupant, said support body being slidably interconnected to said base component by a slide arrangement, said slide arrangement comprising a first longitudinal slot and a first transverse slot oriented transversely to said longitudinal slot which are disposed on said base component and a second longitudinal slot and a second transverse slot oriented transversely to said second longitudinal slot which are disposed on said support body, said first longitudinal slot being disposed vertically adjacent to said second transverse slot in overlapping relation therewith wherein a first slide pin extends vertically through both said first longitudinal slot and said second transverse slot, said first transverse slot being disposed vertically adjacent to said second longitudinal slot in overlapping relation therewith and having a second slide pin extending vertically through both said first transverse slot and said second transverse slot, opposite ends of said support body being displaceable both sidewardly along said transverse slots and longitudinally along said longitudinal slots to permit transverse, longitudinal and angular displacement of said support body relative to said base component.

2. The chair according to claim 1, wherein a locking mechanism is provided which is disengageable to selectively permit displacement of said support body and engageable to lock out said sliding movement of said support body in a desired transverse, longitudinal and/or angular position.

3. The chair according to claim 2, wherein said locking mechanism comprises at least two vertically displaceable locking pins and an actuator which selectively displaces said locking pins vertically, said locking mechanism further including an arrangement of locking formations on one of said base component and said support body, said arrangement comprising a pattern of first locking formations disposed in a region of said first end of said support body and a pattern of second locking formations disposed in a region of said second end of said support body, said first locking pin being engageable in a selected position with said first locking formations and said second locking pin being engageable in a selected position with said second locking formations wherein the relative positions of said first and second locking pins selectively lock said support body in a selected transverse, longitudinal and angular position.

4. The chair according to claim 3, wherein said first locking formations comprise a plurality of parallel elongate slots which extend longitudinally and are laterally spaced apart wherein engagement of said first locking pin with one of said slots prevents transverse movement of said first end of said support body.

5. The chair according to claim 4, wherein said second locking formations comprise transverse rows and longitudinal columns of discrete openings which have a shape that corresponds to a shape of said second locking pin, said openings adapted to prevent transverse and longitudinal displacement of said second locking pin when engaged therewith to prevent transverse displacement of said second end of said support body and longitudinal displacement of said second end.

6. The chair according to claim 3, wherein said first locking formations comprise a plurality of parallel elongate slots which extend longitudinally and are laterally spaced apart wherein engagement of said first locking pin with one of said slots prevents transverse movement of said first end of said support body.

7. The chair according to claim 1, wherein said base component has a top plate formed with said first longitudinal slot and said first transverse slot, said base component further including a longitudinal guide slot and a transverse guide slot which are disposed below and extend parallel to said first longitudinal slot and said first transverse slot respectively, said guide slots receiving enlarged heads of said first and second guide pins to prevent vertical removal of said guide pins from said base component.

8. The chair according to claim 7, wherein said guide pins are slidable longitudinally along said longitudinal and transverse guide slots.

9. The chair according to claim 1, wherein said guide pins have opposite ends thereof connected to said base component and said support body respectively to prevent removal of said support body from said base component while permitting said longitudinal, transverse and angular displacement thereof.

10. A chair having an adjustable body support assembly comprising:

a base component which is supported on said chair and includes a first support member;

a support body which has an enlarged surface for supporting a body of a chair occupant and includes a second support member; and a connector arrangement securing said support body on said base component with said first and second support members being disposed in juxtaposed relation and movable relative to each other, said base component having a longitudinal axis and a lateral axis oriented transversely to said longitudinal axis, said connector arrangement having guide members extending between and connected to said first and second support members which permit opposite first and second ends of said support body to move both longitudinally and laterally such that said support body is displaceable along said longitudinal axis in a longitudinal direction and laterally along said lateral axis in said lateral direction, said opposite ends of said support body further being slidable in opposite lateral directions to permit angular rotation of said support body relative to said second support plate about a non-fixed rotation axis wherein the location of said rotation axis is variable relative to said first and second support members.

11. The chair according to claim 10, wherein said support body is an armrest disposed on a side of said chair.

12. The chair according to claim 11, wherein said longitudinal axis and said lateral axis extend respectively in front-to-back and side-to-side directions of said chair.

13. The chair according to claim 10, wherein said connector arrangement includes a first set and a second set of cooperating slots wherein each said set of slots comprises overlapping first and second slots wherein one of said overlapping first and second slots is disposed on said base component and another of said overlapping first and second slots is disposed on said support body, said first slot and said second slot of each said set being oriented transversely to each other and having a guide pin extending vertically through said overlapping first and second slots of each said set to govern movement of said opposite ends of said support body in said longitudinal and said lateral directions.

14. The chair according to claim 13, wherein opposite ends of each said guide pin are fixed to said base component and said support body respectively to prevent removal of said support body from said base component.

15. The chair according to claim 13, wherein each said set comprises one of said first and second slots extending transversely and the other of said first and second slots extending longitudinally.

16. The chair according to claim 15, wherein each of said support body and said base component includes said transverse slot of one said set and said longitudinal slot of the other said set which are spaced apart from each other along said longitudinal axis.

17. The chair according to claim 10, wherein said chair includes a locking mechanism having an actuator which is actuatable to permit displacement of said support body and releasable to permit locking of said support body relative to said base component in an orientation and position defined by said longitudinal, lateral and angular displacement of said support body.

18. The chair according to claim 17, wherein said locking mechanism includes first and second patterns of locking formations defined on one of said base component and said support body and locking pins disposed on the other of said base component and said support body wherein each said locking pin engages one of said first and second patterns of said formations, said first pattern of locking formations restricting movement of said support body in both of said lateral and longitudinal directions, and said second pattern of locking formations restricting movement of said support body in only one of said lateral and longitudinal directions.

19. The chair according to claim 18, wherein said second pattern of locking formations comprises parallel elongate slots which extend longitudinally which restrain movement of said support body in only said lateral direction.

20. The chair according to claim 19, wherein said locking formations of said first pattern are bi-directional locking formations which restrict movement of said support body in both said lateral direction and said longitudinal direction.

21. The chair according to claim 20, wherein said bi-directional locking formations are defined by a grid of recesses arranged in transverse rows and longitudinal columns.

22. The chair according to claim 18, wherein said locking formations of said second pattern are uni-directional which restrain movement of said support body in only one of said lateral and longitudinal directions.

23. The chair according to claim 22, wherein said uni-directional locking formations comprise elongate slots wherein said associated guide pin extends longitudinally along a length of said slots.

24. A chair having an adjustable body support assembly comprising:

a base component supported on said chair;

a support body having an enlarged support surface for supporting a body of a chair occupant, said support body being connected to said base component so as to be movable in both lateral and longitudinal directions wherein opposite ends of said support body are movable in opposite lateral directions to permit angular displacement of said support body relative to said base component, said chair including first and second patterns of locking formations on one of said support body and said base component wherein said formations of said first pattern are bi-directional formations which restrain movement of said support body in said lateral and longitudinal directions and said formations of said second pattern are uni-directional formations which allow movement in said longitudinal axis while preventing movement of said support body in said lateral direction, said chair further including a locking mechanism with movable lock members which are engageable with said first and second formations to lock said support body in a selected position after said longitudinal, lateral and/or angular displacement of said body.

25. The chair according to claim 24, wherein said support body is an armrest disposed on a side of said chair.

26. The chair according to claim 25, wherein said longitudinal direction is in a front-to-back direction of said chair and said lateral direction is in a side-to-side direction of said chair.

27. The chair according to claim 24, wherein said lock member engaged with said first formation is unrestrained longitudinally along said formations of said second pattern.

28. The chair according to claim 27, wherein said bi-directional formations are spaced apart in said lateral direction and said longitudinal direction and said lock member associated therewith is individually engageable with a selected one of said bi-directional formations.

29. The chair according to claim 24, wherein said bi-directional formations are spaced apart in said lateral direction and said longitudinal direction and said lock member associated therewith is individually engageable with a selected one of said bi-directional formations.

30. A chair having an adjustable body support assembly comprising:

a base component supported on said chair; and a support body movably engaged with said base component, one of said base component and said support body including a pattern of parallel slots which extend longitudinally and a pattern of holes arranged in lateral rows and longitudinal columns, said chair further including a pair of first and second locking pins which are engageable respectively with a selected one of said slots and a selected one of said holes wherein said hole prevents lateral and longitudinal displacement of said first pin and said slot prevents lateral displacement of said second pin while said second pin is unrestrained longitudinally within said slot, an actuator being engaged with said pins to vertically displace said pins and disengage said pins from said slots and holes to permit displacement of said support body longitudinally, laterally and/or angularly.

31. The chair according to claim 30, wherein said support body is an armrest disposed on a side of said chair, said support body extending horizontally along a side of said chair.

32. The chair according to claim 30, wherein said actuator is rotatably connected to the other of said support body and said base component and includes a cam arrangement for vertically displacing said pins.

33. The chair according to claim 30, wherein said slots and holes are defined in a removable plate on said one of said base component and said support body.

34. The chair according to claim 1, wherein said support body is an armrest disposed on a side of said chair.

35. The chair according to claim 34, wherein said longitudinal slots extend longitudinally in a front-to-back direction of said chair, and said transverse slots extend sidewardly in a side-to-side direction of said chair.

36. A chair having an adjustable armrest assembly comprising:

a support post unit supported on said chair;

an armrest having an enlarged surface for supporting an arm of a chair occupant;

a connector arrangement securing said armrest on said support post unit, said support post unit having a longitudinal axis and a lateral axis oriented transversely to said longitudinal axis, said connector arrangement permitting opposite first and second ends of said armrest to move both longitudinally and laterally such that said support body is displaceable along said longitudinal axis in a longitudinal direction and laterally along said lateral axis in a lateral direction, said opposite ends of said support body further being displaceable in opposite lateral directions to adjust an angular orientation of said support body relative to said base component; and a locking device which is releasably engaged between said armrest and said support post unit to selectively lock out movement of said armrest relative to said support post unit, said locking device including a manual actuator which is manually actuated to selectively release and engage said locking device, said locking device when released permitting displacement of said armrest, and said locking device when engaged simultaneously preventing displacement of said armrest in all of said longitudinal, lateral and angular directions and thereby locking said armrest relative to said support post unit in a fixed orientation and position defined by said longitudinal, lateral and angular displacement of said armrest.

37. The chair according to claim 36, wherein said connector arrangement includes a first set and a second set of cooperating slots wherein each said set of slots comprises one slot on said support post unit and an other slot on said armrest, said one slot and said other slot of each said set being oriented transversely to each other and having a guide member extending vertically through said one and said other slots of each said set to govern movement of said opposite ends of said support body in said longitudinal and said lateral directions.

38. The chair according to claim 37, wherein each said set comprises said one slot extending transversely and said other slot extending longitudinally and being disposed one next to the other.

39. The chair according to claim 36, wherein said locking mechanism includes first and second patterns of locking formations defined on one of said support post unit and said armrest and movable locking members disposed on the other of said support post unit and said armrest wherein each said locking member engages one of said first and second patterns of said formations, said first pattern of locking formations restricting movement of said armrest in both of said lateral and longitudinal directions, and said second pattern of locking formations restricting movement of said armrest in only one of said lateral and longitudinal directions.

40. The chair according to claim 39, wherein said second pattern of locking formations comprises parallel elongate slots which extend longitudinally and receive a said locking member therein to restrain movement of said armrest in only said lateral direction.

41. The chair according to claim 40, wherein said second pattern of locking formations comprises a grid of recesses arranged in transverse rows and longitudinal columns and receive a said locking member therein to restrain movement of said armrest relative thereto in both of said lateral and longitudinal directions.

42. A chair having an adjustable armrest assembly comprising:

a base component supported on said chair; and an armrest movably engaged with said base component, one of said base component and said armrest including a pattern of parallel slots which extend longitudinally and a pattern of holes arranged in lateral rows and longitudinal columns, said chair further including a pair of movable first and second locking members which are insertable respectively within a selected one of said slots and a selected one of said holes wherein each said hole prevents lateral and longitudinal displacement of said first locking member therein and said slot prevents lateral displacement of said second locking member while said second locking member is unrestrained longitudinally within said slot, said first and second locking members being vertically displaceable wherein vertical displacement of said locking members disengages said locking members from said slots and holes to permit displacement of said armrest longitudinally, laterally and/or angularly.

43. The chair according to claim 42, wherein said slots and holes are defined in a flat face on said one of said base component and said armrest and said locking members are movably supported on the other of said base component and said armrest.

* * * * *